US006170576B1

(12) United States Patent
Brunnert et al.

(10) Patent No.: US 6,170,576 B1
(45) Date of Patent: Jan. 9, 2001

(54) MILLS FOR WELLBORE OPERATIONS

(75) Inventors: David Joseph Brunnert; Shane Paul Hart; Thomas F Bailey, all of Houston; Michael W. Henson, San Angelo; David M Haugen, League City; Thurman B Carter, Houston; Guy LaMonte McClung, III, Sperry, all of TX (US)

(73) Assignee: Weatherford/Lamb, Inc., Houston, TX (US)

( * ) Notice: Under 35 U.S.C. 154(b), the term of this patent shall be extended for 0 days.

(21) Appl. No.: 09/257,294

(22) Filed: Feb. 25, 1999

Related U.S. Application Data

(63) Continuation-in-part of application No. 08/915,836, filed on Aug. 21, 1997, now Pat. No. 5,984,005, which is a continuation-in-part of application No. 08/846,092, filed on May 1, 1997, now Pat. No. 5,908,071, which is a continuation-in-part of application No. 08/532,474, filed on Sep. 22, 1995, now Pat. No. 5,626,189.

(51) Int. Cl.[7] ..... E21B 29/06; E21B 10/62

(52) U.S. Cl. ..... 166/298; 166/55.6; 175/426

(58) Field of Search ..... 166/298, 50, 117.6, 166/55.6, 55.1; 175/426, 432

(56) References Cited

U.S. PATENT DOCUMENTS

| | | | |
|---|---|---|---|
| Re. 30,908 | 4/1982 | Friedline | 407/114 |
| D. 298,633 | 11/1988 | Kenemore | D15/139 |
| D. 317,010 | 5/1991 | Knemeyer | D15/21 |

(List continued on next page.)

FOREIGN PATENT DOCUMENTS

| | | | |
|---|---|---|---|
| 1070898 | 12/1959 | (DE) . | |
| 0 376 433 | 7/1990 | (EP) . | |
| 0492457 A2 | 1/1992 | (EP) | E21B/10/56 |
| 0581534 A1 | 2/1994 | (EP) | E21B/10/56 |
| 0916803 A2 | 5/1999 | (EP) | E21B/10/46 |
| 78-22007 | 2/1980 | (FR) . | |
| 2 096 669 | 10/1982 | (GB) . | |
| 2116094 | 9/1983 | (GB) | B23F/21/16 |
| 2270097 | 1/1992 | (GB) . | |
| 2280692 | 5/1993 | (GB) . | |
| 91-16265622 | 7/1990 | (SU) . | |
| WO 95/03473 | 2/1995 | (WO) . | |
| WO 97/13954 | 4/1997 | (WO) | E21B/29/06 |
| WO 98/34007 | 8/1998 | (WO) | E21B/29/06 |
| WO 99/04128 | 1/1999 | (WO) | E21B/10/00 |

OTHER PUBLICATIONS

PCT/GB00/00656 Annex to Form PCT/15A/206, 5 pp.
"High Efficiency Metal Cutting Inserts," General Electric, p. 24; 1979.
"Turning Tools and Inserts," Sandvik Coromant, pp. 6, 34, 43, 46; 1984.
"NewsLine," Iscar, Ltd., pp. 3, 6, 9, 57, 58, 63, 66, 69, 70, 71; 1993.
"Kennametal Tooling Applications Program," Kennametal, Inc.; pp. 9, 52, 53, 54, 55.
"Quick Reference Catalog," Sandvik Coromant, pp. 2–6; 1994.
"Cut Grip Specials," Iscar, Ltd.; 1993.
PCT Int'l Search Report PCT/GB98/02464.
Int'l Search Report, PCT/GB98/01117 with Notification of Transmittal.

*Primary Examiner*—Hoang Dang
(74) *Attorney, Agent, or Firm*—Guy McClung

(57) ABSTRACT

A wellbore mill has been invented that, in certain aspects, has a body having a top and a bottom and, optionally, a fluid flow channel extending therethrough from top to bottom with, optionally, one or more fluid jetting ports in fluid communication with the fluid flow channel, milling apparatus on the body including a plurality of milling inserts, each insert mechanically secured in a corresponding recess in the body, said mechanical securement sufficient for effective milling in a wellbore. A wellbore milling method for milling an opening in a selected tubular of a tubular string in a wellbore has been invented that includes installing and using such a mill.

27 Claims, 18 Drawing Sheets

U.S. PATENT DOCUMENTS

| | | | | |
|---|---|---|---|---|
| D. 330,026 | | 10/1992 | Slutz | D15/139 |
| D. 405,811 | | 3/1999 | Arfele et al. | D15/139 |
| 1,522,593 | | 1/1925 | Pickin . | |
| 1,681,675 | | 8/1928 | Miller . | |
| 2,039,427 | * | 5/1936 | Kinzbach | 175/426 |
| 2,213,498 | * | 9/1940 | Kinzbach | 166/55.3 |
| 2,328,494 | | 8/1943 | Reaney | 29/105 |
| 2,333,653 | | 11/1943 | Kraus | 407/55 |
| 2,370,273 | | 2/1945 | Vlliman | 407/55 |
| 2,975,507 | | 3/1961 | Wilder | 29/105 |
| 3,188,717 | | 6/1965 | Heinlein | 29/96 |
| 3,381,349 | | 5/1968 | Newcomer | 29/96 |
| 3,603,414 | * | 9/1971 | Stebley | 175/374 |
| 3,636,602 | | 1/1972 | Owen | 29/95 |
| 3,701,187 | | 10/1972 | Erkfritz | 29/95 |
| 3,875,631 | | 4/1975 | Malinchak | 29/95 R |
| 3,947,937 | | 4/1976 | Hertel | 29/95 R |
| 4,068,976 | | 1/1978 | Friedline | 407/114 |
| 4,086,016 | | 4/1978 | Goeke | 407/114 |
| 4,119,151 | | 10/1978 | Smith | 166/298 |
| 4,140,431 | | 2/1979 | Friedline et al. | 407/114 |
| 4,244,432 | | 1/1981 | Rowley et al. | 175/329 |
| 4,271,917 | * | 6/1981 | Sahley | 175/426 |
| 4,273,480 | | 6/1981 | Shirai et al. | 407/114 |
| 4,278,369 | | 7/1981 | Jakobs et al. | 407/113 |
| 4,335,984 | | 6/1982 | Zweekly | 407/114 |
| 4,340,325 | | 7/1982 | Gowanlock | 407/116 |
| 4,449,864 | | 5/1984 | Haque et al. | 407/113 |
| 4,452,325 | | 6/1984 | Rudd et al. | 175/410 |
| 4,472,093 | | 9/1984 | Hamilton | 407/41 |
| 4,487,534 | | 12/1984 | Reiter | 407/114 |
| 4,520,882 | * | 6/1985 | Van Nederveen | 175/426 |
| 4,531,864 | | 7/1985 | Bylund | 407/114 |
| 4,552,492 | | 11/1985 | Komanduri et al. | 407/114 |
| 4,583,431 | | 4/1986 | Komanduri et al. | 82/1 C |
| 4,588,332 | | 5/1986 | Komanduri et al. | 407/114 |
| 4,593,777 | | 6/1986 | Barr | 175/379 |
| 4,606,678 | | 8/1986 | Zweekly | 407/114 |
| 4,618,009 | | 10/1986 | Carter et al. | 175/267 |
| 4,629,371 | | 12/1986 | Maeda et al. | 407/114 |
| 4,629,372 | | 12/1986 | Huston | 407/116 |
| 4,655,648 | | 4/1987 | Hellbergh | 407/42 |
| 4,705,434 | | 11/1987 | Patterson et al. | 407/114 |
| 4,717,290 | | 1/1988 | Reynolds et al. | 407/34 |
| 4,796,709 | | 1/1989 | Lynde et al. | 166/55.6 |
| 4,844,643 | | 7/1989 | Icks | 407/42 |
| 4,854,785 | | 8/1989 | Lowe et al. | 407/115 |
| 4,872,520 | | 10/1989 | Nelson | 175/430 |
| 4,887,668 | | 12/1989 | Lynde et al. | 166/55.8 |
| 4,911,254 | | 3/1990 | Keith | 175/329 |
| 4,934,879 | | 6/1990 | VanBarneveld | 407/66 |
| 4,938,291 | | 7/1990 | Lynde et al. | 166/55.8 |
| 4,946,318 | | 8/1990 | David et al. | 407/42 |
| 4,969,779 | | 11/1990 | Barten | 407/114 |
| 4,978,260 | | 12/1990 | Lynde et al. | 166/55.6 |
| 4,984,488 | | 1/1991 | Lynde et al. | 166/55.6 |
| 5,010,967 | * | 4/1991 | Desai | 175/406 |
| 5,014,778 | | 5/1991 | Lynde et al. | 166/55.6 |
| 5,027,914 | | 7/1991 | Wilson | 175/406 |
| 5,028,175 | | 7/1991 | Pawlik | 407/40 |
| 5,038,859 | | 8/1991 | Lynde et al. | 166/55.6 |
| 5,044,840 | | 9/1991 | Fouquer et al. | 407/114 |
| 5,058,666 | | 10/1991 | Lynde et al. | 166/55.6 |
| 5,059,069 | | 10/1991 | Lagerberg | 407/113 |
| 5,070,952 | | 12/1991 | Neff | 175/426 |
| 5,076,739 | | 12/1991 | Pano | 407/116 |
| 5,078,550 | | 1/1992 | Satran et al. | 407/34 |
| 5,085,542 | | 2/1992 | Nakayama et al. | 407/114 |
| 5,086,838 | | 2/1992 | Cassel et al. | 166/55.6 |
| 5,109,924 | * | 5/1992 | Jurgens et al. | 166/117.6 |
| 5,112,162 | | 5/1992 | Hartford et al. | 407/49 |
| 5,137,396 | | 8/1992 | Durschinger | 407/116 X |
| 5,150,755 | | 9/1992 | Cassel et al. | 166/297 |
| 5,158,401 | | 10/1992 | Pawlik | 407/40 |
| 5,158,402 | | 10/1992 | Satran et al. | 407/113 |
| 5,180,258 | | 1/1993 | Bernadic | 407/114 |
| 5,181,564 | | 1/1993 | Lindley et al. | 166/55.6 |
| 5,199,513 | | 4/1993 | Stewart et al. | 175/73 |
| 5,209,611 | | 5/1993 | Drescher | 407/114 X |
| 5,221,164 | | 6/1993 | Allaire | 407/175 |
| 5,253,710 | | 10/1993 | Carter et al. | 166/298 |
| 5,297,630 | | 3/1994 | Lynde et al. | 166/297 |
| 5,318,115 | | 6/1994 | Bouse | 166/55.7 |
| 5,341,873 | | 8/1994 | Carter et al. | 166/117.5 |
| 5,373,900 | | 12/1994 | Lynde et al. | 166/297 |
| 5,409,060 | | 4/1995 | Carter | 166/237 |
| 5,425,417 | | 6/1995 | Carter | 166/117.6 |
| 5,429,187 | | 7/1995 | Beagrie et al. | 166/55.1 |
| 5,449,225 | | 9/1995 | Katbi et al. | 407/114 |
| 5,452,759 | | 9/1995 | Carter et al. | 166/117.6 |
| 5,456,312 | | 10/1995 | Lynde et al. | 166/55.6 |
| 5,472,376 | | 12/1995 | Olmstead et al. | 451/540 |
| 5,588,497 | * | 12/1996 | Thorburn | 175/420.1 |
| 5,595,247 | * | 1/1997 | Braddick | 166/297 |
| 5,626,189 | | 5/1997 | Hutchinson | 166/55.6 |
| 5,678,645 | | 10/1997 | Tibbitts et al. | 175/426 |
| 5,706,906 | | 1/1998 | Jurewicz et al. | 175/428 |
| 5,727,910 | | 3/1998 | Leeb | 407/34 |
| 5,727,911 | | 3/1998 | Satran et al. | 407/42 |
| 5,769,167 | | 6/1998 | Braddick | 166/382 |
| 5,772,366 | | 6/1998 | Wiman et al. | 407/119 |
| 5,778,995 | | 7/1998 | McGarian | 175/420.1 |
| 5,788,000 | | 8/1998 | Maury et al. | 175/325.1 |
| 5,788,001 | | 8/1998 | Matthias et al. | 175/432 |
| 5,791,409 | | 8/1998 | Flanders | 166/55.8 |
| 5,791,422 | | 8/1998 | Liang et al. | 175/374 |
| 5,791,423 | | 8/1998 | Overstreet et al. | 175/375 |
| 5,803,194 | | 9/1998 | Rowlett | 175/325.2 |
| 5,803,196 | | 9/1998 | Fielder | 175/431 |
| 5,813,105 | | 9/1998 | Littecke et al. | 29/411 |
| 5,816,347 | | 10/1998 | Dennis et al. | 175/432 |
| 5,846,032 | | 12/1998 | Kami | 407/102 |
| 5,868,212 | | 2/1999 | McManus | 175/325.4 |
| 5,871,060 | | 2/1999 | Jensen et al. | 175/420.2 |
| 5,887,668 | | 3/1999 | Haugen et al. | 175/79 |
| 5,904,213 | * | 5/1999 | Caraway et al. | 175/393 |
| 5,908,071 | | 6/1999 | Hutchinson et al. | 166/55.6 |

* cited by examiner

MILLS FOR WELLBORE OPERATIONS

RELATED APPLICATION

This is a continuation-in-part of application U.S. Ser. No. 08/915,836 filed Aug. 21, 1997 entitled "Wellbore Milling Inserts & Mills," now U.S. Pat. No. 5,984,005, which is a continuation-in-part of U.S. application Ser. No. 08/846,092 entitled "Wellbore Mills & Inserts" filed on May 1, 1997, now U.S. Pat. No. 5,908,071, which is a continuation-in-part of U.S. application Ser. No. 08/532,474 filed Sep. 22, 1995 and issued as U.S. Pat. No. 5,626,189 on May 6, 1997 all of which are incorporated fully herein for all purposes.

BACKGROUND OF THE INVENTION

1. Field of the Invention

This invention is related to wellbore mills, wellbore milling processes, milling tools and whipstocks; and in one aspect to milling processes which employ a diverter or a whipstock. Various milling methods and systems are disclosed.

2. Description of Related Art

In wellbore operations, milling tools are used to cut out windows or pockets from a tubular, e.g. for directional drilling and sidetracking; and to remove materials downhole in a well bore, such as pipe, casing, casing liners, tubing, or jammed tools. Many wellbore milling tools have a plurality of cutting elements or "inserts" secured to milling blades and/or milling surfaces. Typically these inserts are fixed on the blades by brazing or welding. In certain prior art mills, holes are provided into which part of the insert is inserted and by which the insert is held in place prior to brazing or welding.

A variety of problems are associated with efforts to braze or weld inserts onto milling tools. Many types of welding require specific material pretreatments and specific heat treatments before, during, and after welding. When welding methods are used undesirable temperature-induced changes to a base metal or to an insert may result. These changes can be irreversible. Also with such methods inserts may be secured in consistently, i.e. adhesion may differ from insert to insert. Variations in thermal coefficients of expansion between materials e.g. between carbides and bonding materials, can result in undesirable cracks during cooling. Verification of adhesion quality is difficult. If brazing is employed, carbide selection may be limited, e.g. possibly coated carbides may not be usable. With certain welding methods inserts are not precisely located and are placed inconsistently.

The prior art discloses various types of milling or cutting tools provided for cutting or milling existing pipe or casing previously installed in a well. These tools have cutting blades or surfaces and are lowered into the well or casing and then rotated in a cutting operation. With certain tools, a suitable drilling fluid is pumped down a central bore of a tool for discharge beneath the cutting blades and an upward flow of the discharged fluid in the annulus outside the tool removes from the well cuttings or chips resulting from the cutting operation.

A section of existing casing can be removed from a well bore with a milling tool, e.g. to permit a sidetracking operation in directional drilling, or to provide a perforated production zone at a desired level. Also, milling tools are used for milling or reaming collapsed casing, for removing burrs or other imperfections from windows in the casing system, for placing whipstocks in directional drilling, or for aiding in correcting dented or mashed-in areas of casing or the like.

Certain prior art sidetracking methods use cutting tools of the type having cutting blades and use a deflector such as a whipstock to cause the tool to be moved laterally while it is being moved downwardly in the well during rotation of the tool to cut an elongated opening pocket, or window in the well casing.

Various prior art well sidetracking operations employ a whipstock and a variety of different milling tools used in a certain sequence. This sequence of operation requires a plurality of "trips" into the wellbore. For example, in certain multi-trip operations, a packer is set in a wellbore at a desired location. This packer acts as an anchor against which tools above it may be urged to activate different tool functions. The packer typically has a key or other orientation indicating member. The packer's orientation is checked by running a tool such as a gyroscope indicator into the wellbore. A whipstock-mill combination tool is then run into the wellbore by first properly orienting a stinger at the bottom of the tool with respect to a concave face of the tool's whipstock. Splined connections between a stinger and the tool body facilitate correct stinger orientation. A starting mill is secured at the top of the whipstock, e.g. with a setting stud and nut. The tool is then lowered into the wellbore so that the packer engages the stinger and the tool is oriented. Slips extend from the stinger and engage the side of the wellbore to prevent movement of the tool in the wellbore. Moving the tool then shears the setting stud, freeing the starting mill from the tool. Rotation of the string with the starting mill rotates the mill. The starting mill has a tapered portion which is slowly lowered to contact a pilot lug on the concave face of the whipstock. This forces the starting mill into the casing to mill off the pilot lug and cut an initial window in the casing. The starting mill is then removed from the wellbore. A window mill, e.g. on a flexible joint of drill pipe, is lowered into the wellbore and rotated to mill down from the initial window formed by the starting mill. Typically then a window mill with a watermelon mill mills all the way down the concave face of the whipstock forming a desired cut-out window in the casing. This may take multiple trips. Then, the used window mill is removed and a new window mill and string mill and a watermelon mill are run into the wellbore with a drill collar (for rigidity) on top of the watermelon mill to lengthen and straighten out the window and smooth out the window-casing-open-hole transition area. The tool is then removed from the wellbore.

There has long been a need for an efficient and effective milling method which is not dependent on an insert brazing or welding method. There has long been a need for wellbore milling with an optimum density of cutting inserts. There has long been a need, recognized by the present inventors, for a mill with inserts installed without brazing or welding. There has long been a need for such a mill with precisely placed inserts. There has long been a need for such a mill that is effective in milling relatively hard material that is difficult to machine, e.g. but not limited to, high chrome casing.

SUMMARY OF THE PRESENT INVENTION

The present invention, in at least certain embodiments, discloses a wellbore mill having a mill body and a plurality of cutting elements or milling inserts mechanically secured in corresponding holes or recesses in the mill body. Such a mill may be any known wellbore mill, including, but not limited to, window mills, starting mills, watermelon mills, pilot mills, section mills, and junk mills. In certain aspects, the inserts are all substantially the same and protrude substantially the same distance out from the mill body. In other aspects, any or all of these parameters differ for different inserts of the plurality of inserts: diameter, length, shape, specific insert material, and depth of securement in the mill body. For example, and not by way of limitation, inserts shapes, viewed e.g. from above, may be circular, elliptical, square, triangular, trapezoidal, rectangular, pentagonal, hexagonal, etc.

It is within the scope of this invention to employ any known cutting or milling insert. One particular type of insert useful with mills according to the present invention is a curved top insert used in bits from Mike Henson Bits of San Angelo, Tex. which has been used with prior art drill bits and with mills in a wellbore for milling out an item, e.g. a fish, within the wellbore; but not with prior art mills for milling through a tubular lining or casing in a wellbore. In certain of these prior art bits and prior art mills, a portion of a rounded top of the insert lies below the bit's or mill's outer surface.

In certain embodiments of mills according to the present invention, inserts are mechanically installed in corresponding holes in the mill body, e.g. by press fit, friction fit, force fit, by cooling the insert prior to emplacement e.g. with liquid nitrogen, heat shrink fit, and/or with an appropriate adhesive, e.g. but not limited to epoxy. In addition to, or instead of, a press fit, etc., other mechanical securement may be employed according to the present invention to hold a cutting insert in place, e.g. but not limited to, threaded mating with a hole in a mill body, a set screw that projects into an insert, and/or a threaded tightening wedge insert holder. In certain particular embodiments of the present invention, in addition to the mechanical non-weld securement of any cutting elements and inserts disclosed herein, brazing or welding may also be used. In one aspect brazing or welding may be used at a mill-surface/insert-exterior interface.

Inserts installed on a mill body as described above may continue to mill (or may resume milling) following breaking off of a portion of the insert. Broken-off inserts in prior art mills may continue to cut, but will do so less effectively than certain of the inserts installed according to the present invention.

In one embodiment, a mill according to the present invention is releasably secured to a diverter or a whipstock with or without an anchor, anchor packer, packer, or other anchoring mechanism for a milling operation, particularly for a "single trip" operation.

It is, therefore, an object of at least certain preferred embodiments of the present invention to provide:

New, useful, unique, efficient, non-obvious wellbore mills, milling systems, and methods for milling operations;

Mechanical milling insert securement to a mill body sufficient to achieve effective milling of a tubular in a wellbore;

Milling apparatus with inserts secured to a mill body without brazing or welding;

Methods for using such mills in wellbore operations; and

In one particular aspect, single trip milling operations.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention as broadly as legally possible no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

DESCRIPTION OF EMBODIMENTS PREFERRED AT THE TIME OF FILING FOR THIS PATENT

Figure 1A:
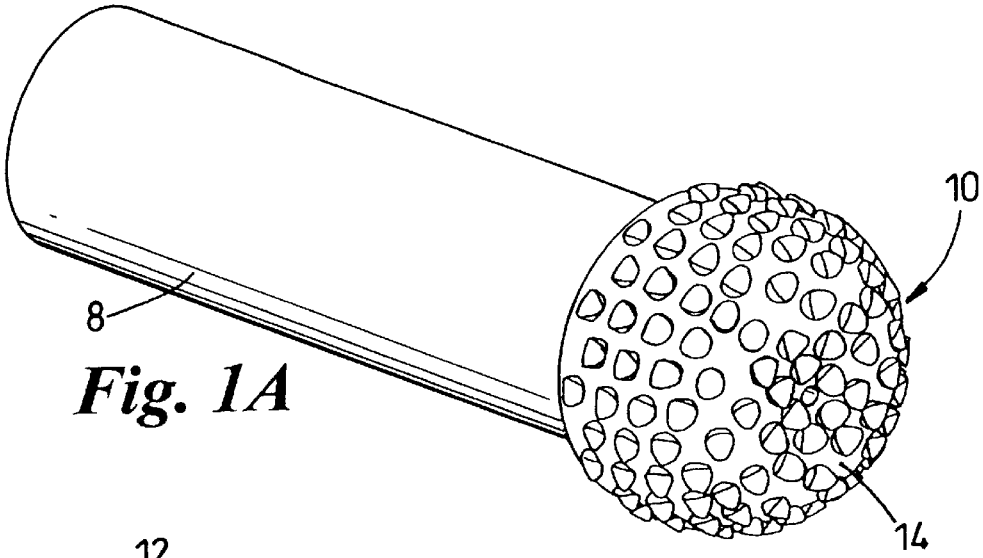
FIG. 1A is a perspective view of a wellbore milling apparatus according to the present invention.
Figure 1B:
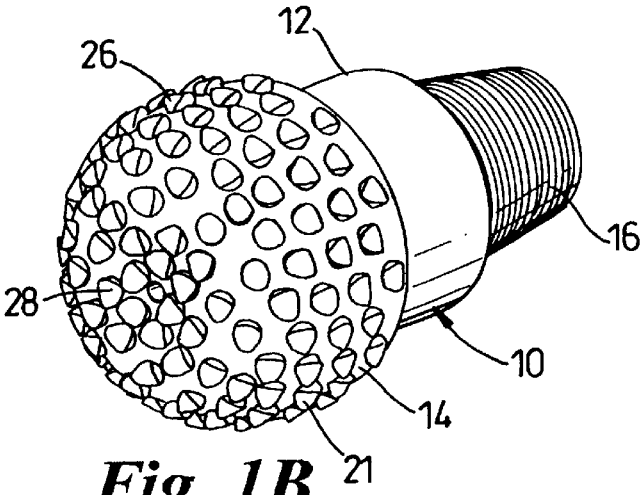
FIG. 1B is a perspective view of a mill of the milling apparatus of FIG. 1A.
Figure 1D:
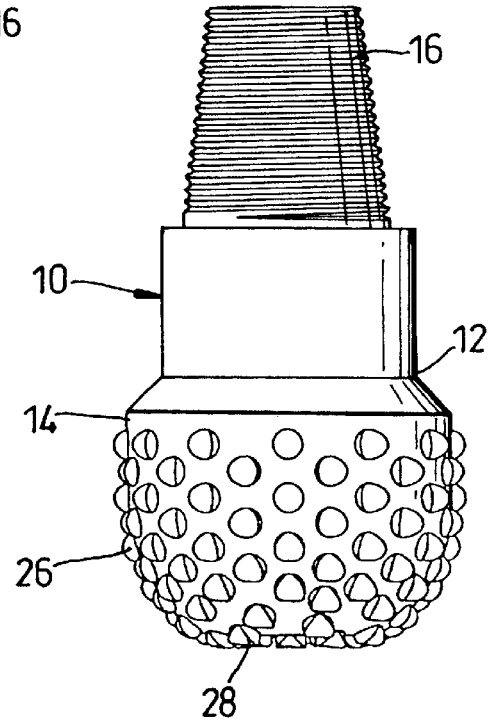
FIG. 1D is a side view of the mill of FIG. 1B.
Figure 1C:
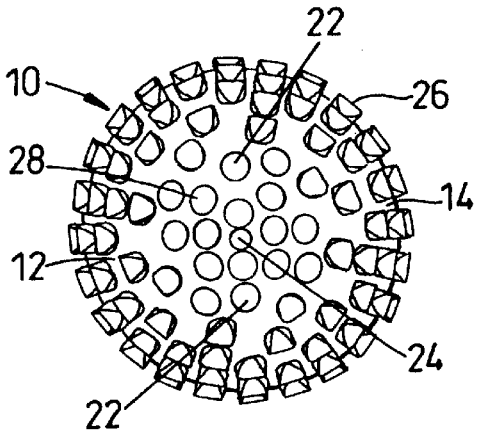
FIG. 1C is an end view of the mill of FIG. 1B.
Figure 1E:
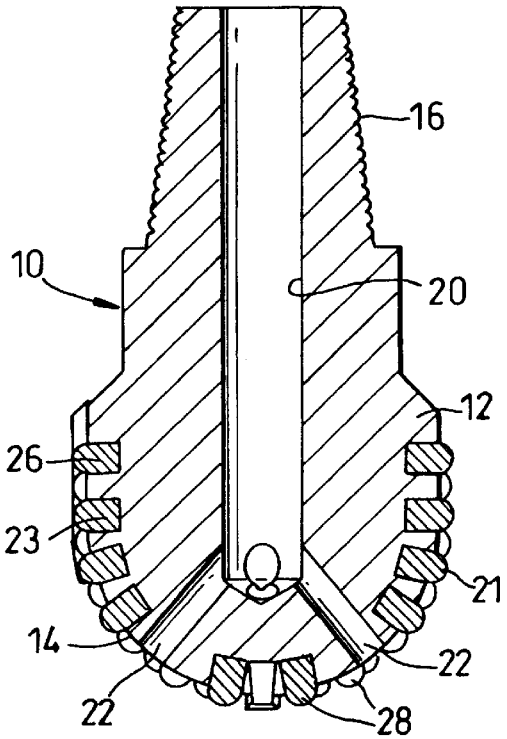
FIGS. 1E–1G are side cross-section views of the mill of FIG. 1B.
Figure 1F:
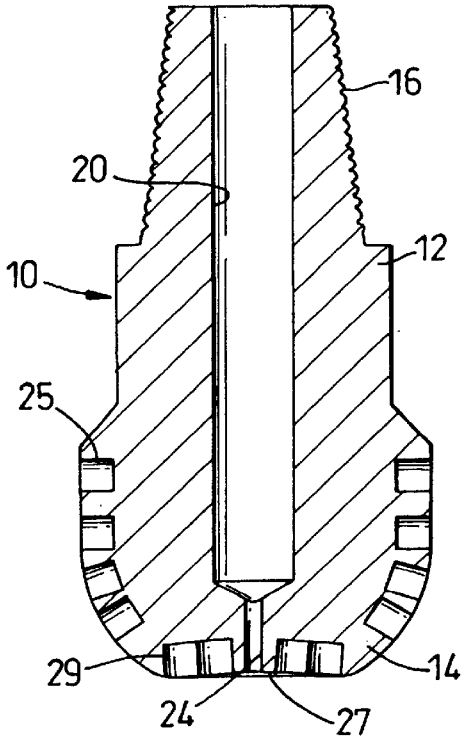
Figure 1G:
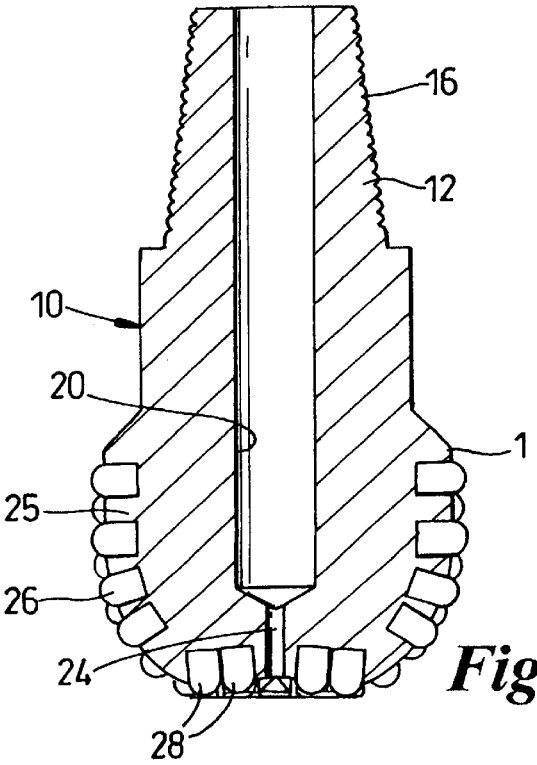

FIGS. 1A–1G show a mill 10 according to the present invention with a mill body 12 having a lower enlarged bulb 14 and an upper threaded connector 16 for threadedly connecting the mill 10 to a correspondingly threaded tubular 8 which may in turn be connected to a tubular string (not shown) run down into an earth wellbore. The tubular 8 and the tubular string have fluid flow bores for directing fluid pumped from the earth surface under pressure to a fluid flow bore 20 of the mill 10.

A plurality of side ports 22 and a central port 24 are in fluid communication with the flow bore 20 so that fluid may be jetted therefrom to facilitate milling, cooling, and the movement of milled cuttings and debris away from the mill 10.

The bulb 14 of the mill 10 has a plurality of side recesses 25 into which are press fit a plurality of corresponding side inserts 26. The lower end of the bulb 14 has a slightly indented central portion 27 and a plurality of end inserts 28 press fit in corresponding recesses 20. Optionally the mill body may be heated and the inserts installed therein prior to cooling and shrinking for a heat-shrink fit, or any other mechanical securement described herein may be used.

Figure 1H:
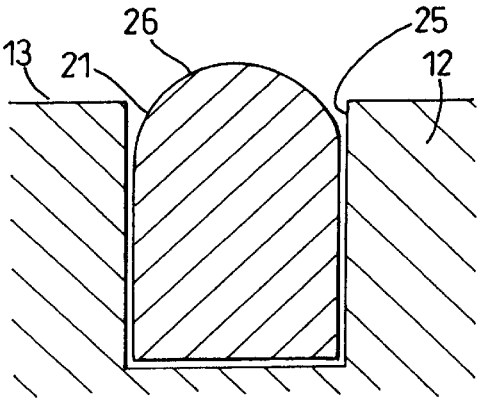
FIG. 1H is a side cross-sectional view of an insert of the mill of FIG. 1A.

As shown the inserts 26 and 28 have a generally cylindrical lower body 23 and a rounded top 21. In one preferred embodiment the lower portions of the rounded top 21 are configured, disposed, and sized so that the edge portions thereof meet the mill body at its surface, while in another embodiment these edge portions are slightly below an outer surface 13 of the mill body 12 (see FIG. 1H) to enhance durability and longevity, although some initial milling performance may be sacrificed. In one aspect the central port 24 is slightly off-center to minimize the size of a milled core produced by milling. Optionally, as with a mill 10*a* similar to the mill 10 of FIG. 1A, the lower end of a bulb 14*a* may be convex or as shown in FIG. 1J, stepped with steps 7 with jet ports 6 and with a stub nose 5. The ports 6 are in fluid communication with a flow bore 20*a*. In certain preferred aspects the central port 24 of the mill 10 is ringed by inserts (e.g. three, four, five or more) as shown, e.g. in FIG. 1C. Thus an insert will "track" behind the port 24 to inhibit coring of the mill. Such a port and such "tracking" inserts may be used with any mill disclosed herein. One or more steps as the steps 7 and/or a stub nose as the stub nose 5 may be used with any mill disclosed herein.

Figure 1I:
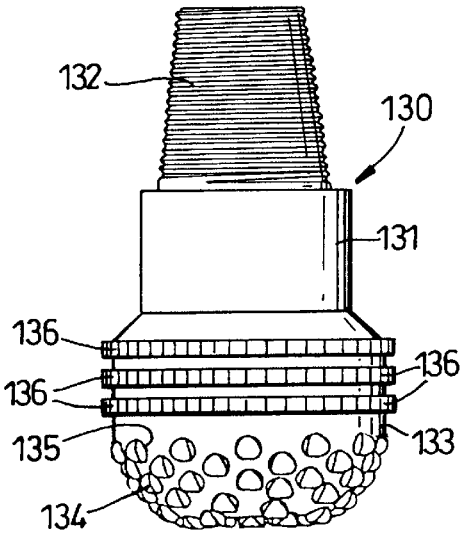
FIG. 1I is a side view of a mill according to the present invention.
Figure 1J:
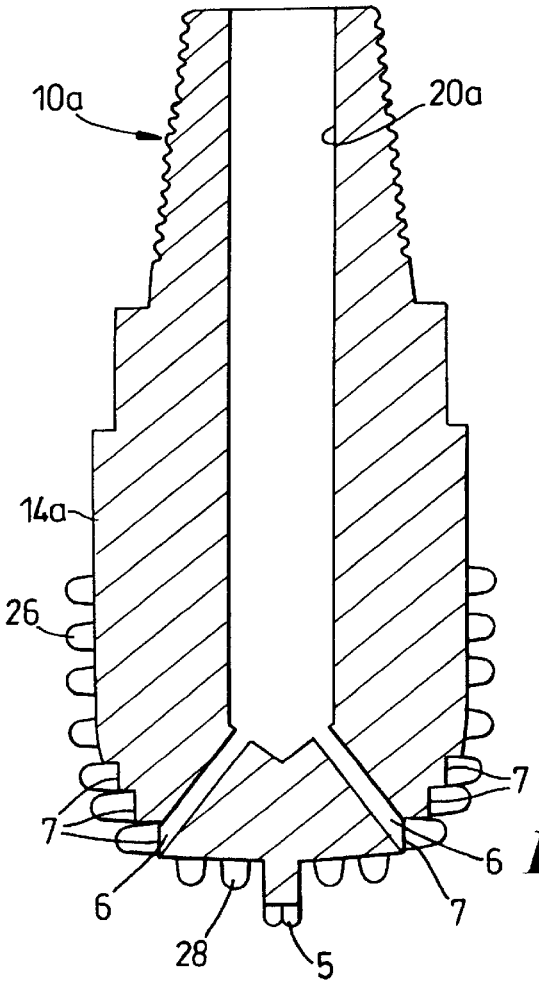
FIG. 1J is a side cross-section view of a mill according to the present invention.

FIG. 1I shows a mill 130 according to the present invention with a body 131 having a top threaded end 132 and a lower bulb end 133. Optionally a fluid flow bore extends through the body 131 and one or more jet ports at the lower bulb end 133 are in fluid communication with the fluid flow bore. A plurality of milling inserts 134 (like any milling insert disclosed herein) are mechanically secured in recesses 135 without welding or brazing. A plurality of conventional prior art milling inserts 136 (of any type) are secured to the body 131 by conventional known prior art welding and/or brazing methods. This illustrates that according to the present invention any conventional known prior art inserts may be applied by known welding and/or brazing techniques to any mill disclosed herein in addition to the inserts applied with mechanical securement alone. It is also possible within the scope of the present invention to place the prior art welded and/or brazed inserts below (as viewed, e.g. in FIG. 1I) the inserts secured mechanically according to the present invention.

Figure 1K:
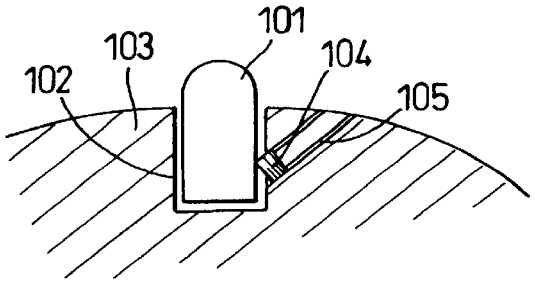
FIG. 1K, 1L and 1M are side cross-section views of an insert in a recess in a body of a mill according to the present invention.

FIG. 1K shows an insert 101 in a recess 203 in a body 103 of a mill (not shown in it entirety; like any mill disclosed herein). An adjustable and removable set screw 104 partially projects from a hole 105 to releasably secure the insert 101 in the recess 102. Such a mechanical securement may be used with any insert disclosed herein.

Figure 1L:
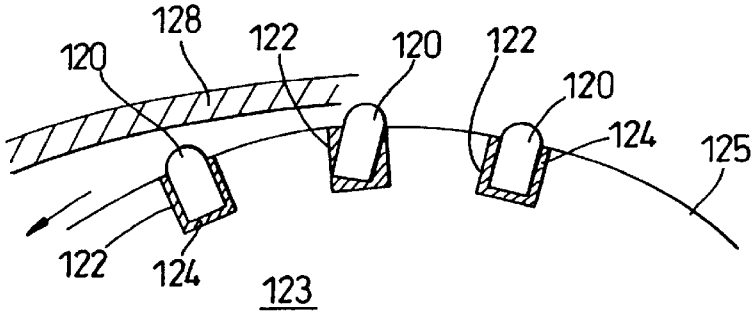
Figure 1L:
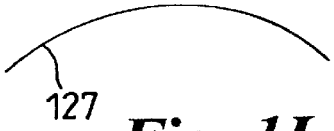

FIG. 1L shows a mill 125 (partially) with a generally cylindrical body 123 having a fluid flow bore 127 therethrough from 26 one end to the other. Each of a plurality of milling inserts 120 (three shown) spaced-apart around the entire circumference of the body 123 are secured in a corresponding recess 122. Each recess 122 is lined with energy dissipating material 124. As a particular insert 120 impacts a tubular to be milled, e.g. casing 128, it is subjected to a high and relatively quick impact force. The energy dissipating material (e.g. but not limited to plastic, fiberglass, relatively soft metal, and/or elastomeric material) damps the impact force on the inserts thus reducing insert wear and damage.

Figure 1M:
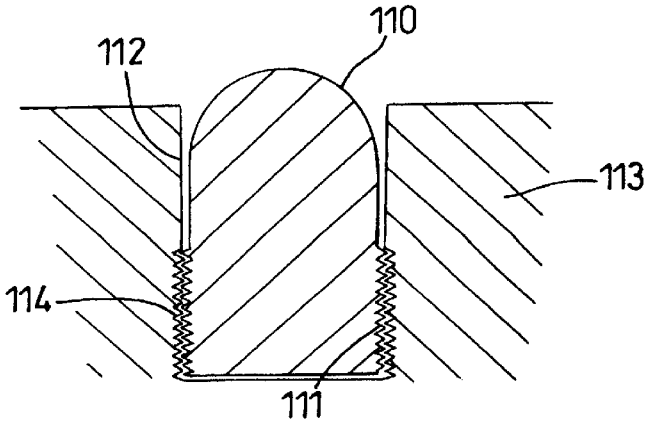

FIG. 1M shows a milling insert 110 with threads 111 threadedly secured in a recess 112 of a body 113 of a mill. The recess 112 has threads 114 corresponding to the threads 111. By unscrewing the insert 110 it is removable from the recess 112 and can be replaced with another insert.

Any of the inserts of FIGS. 1K–1M may be used with any mill disclosed herein.

Figure 2A:
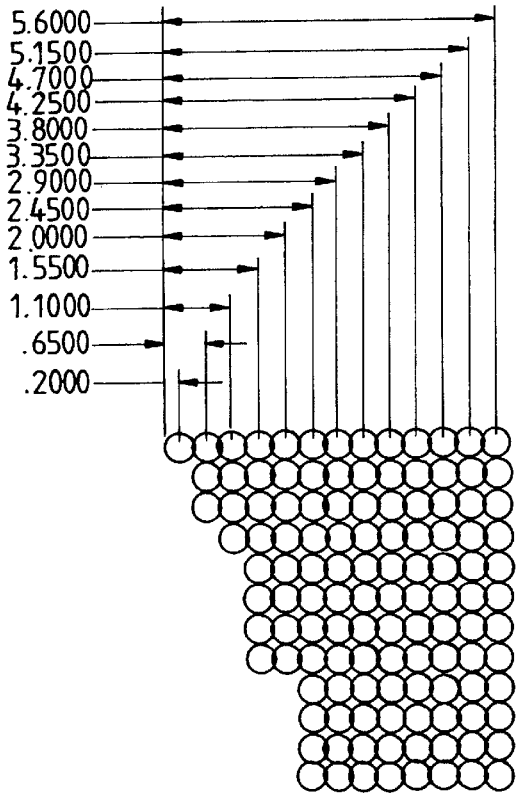
FIGS. 2A and 2B show schematically insert arrays for a mill according to the present invention.
Figure 2B:
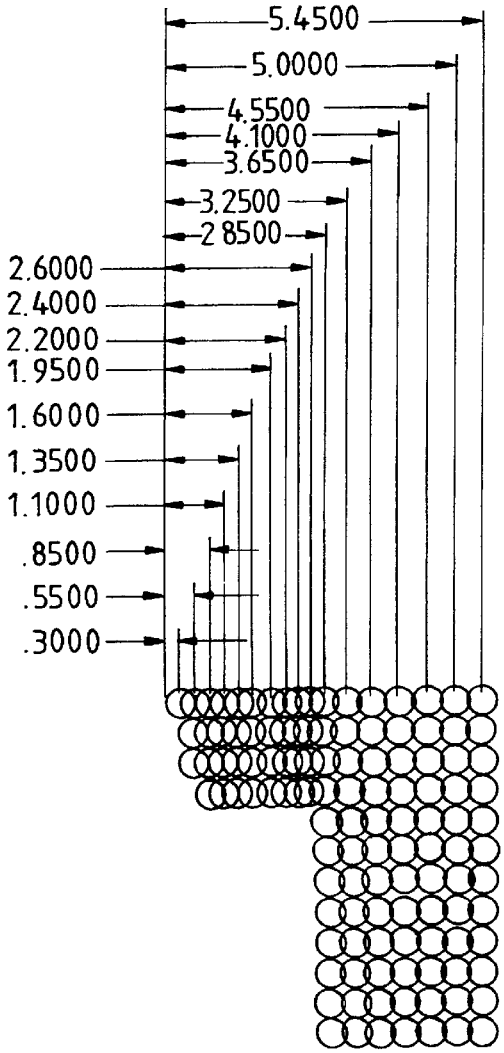

FIGS. 2A and 2B provide schematic representations of two possible insert layouts and arrays for the mill 10. An overlap of two of the circles in either FIG. 2A or 2B indicates an overlap or "full coverage" cutting capability for enhanced milling effectiveness. Such "full" or "double" coverage optimizes insert cutting life and may allow a mill to continue to mill if an insert fails or wears away. The various numerical values shown for the distance between two lines indicate a distance of an insert in inches from a central axis of the mill along the outside surface of the mill. One circle, e.g. in the first column to the left in FIG. 2A, represents a first ring around the mill which, in this case, includes one insert and twelve circles in the farthest right column indicate twelve inserts in that particular ring around the mill.

FIGS. 3A–3D illustrate a mill 30 according to the present invention with a mill body 32 having a lower bulb 34 and an upper threaded connector 36 for threadedly connecting the mill 30 to a correspondingly-threaded tubular (not shown) which may in turn be connected to a tubular string (not shown) run down into an earth wellbore. The tubular and the tubular string have fluid flow bores for directing fluid pumped from the earth surface under pressure to a fluid flow bore 40 of the mill 30. Side ports 33 and a central port 35 (like the ports 22, 24 respectively, of the mill of FIG. 1A) are employed.

The mill 30 has a gauge ring 31 formed integrally of or secured to the bulb 34 which inhibits excessive wear on the outer diameter of the mill 30 and assists in directing the mill 30 along a desired trajectory within a tubular during the milling process.

Figure 3A:
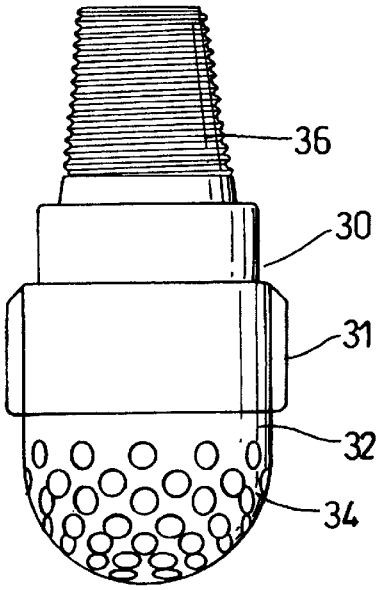
FIG. 3A is a side view of a mill according to the present invention.
Figure 3C:
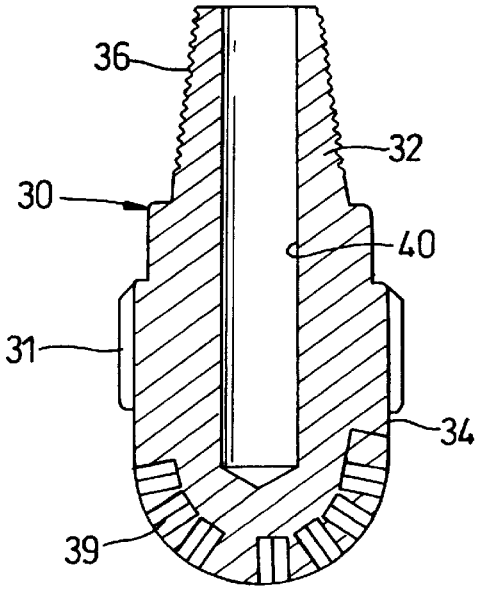
FIG. 3C is a cross-sectional view along line 3C—3C of FIG. 3D.
Figure 3B:
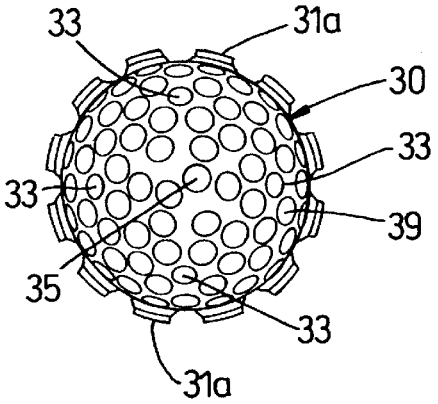
FIG. 3B is an end view of the mill of FIG. 3A.
Figure 3D:
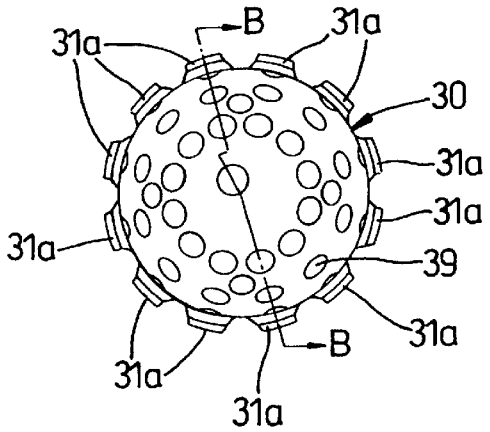
FIG. 3D is an end view of the mill of FIG. 3C.

As shown in FIGS. 3B and 3D, the gauge ring may be comprised of projections 31*a* with spaces therebetween to enhance fluid flow. Optionally, the gauge ring may be a solid integral piece (as viewed in FIG. 3D, e.g.) with or without flow holes therethrough. FIGS. 3A–3D show recesses 39 for inserts. Inserts as in FIG. 1A may be used in each recess. Any insert disclosed herein may be used with the mill 30 (and with any mill disclosed herein), installed, and secured by any method disclosed herein.

Figure 4:
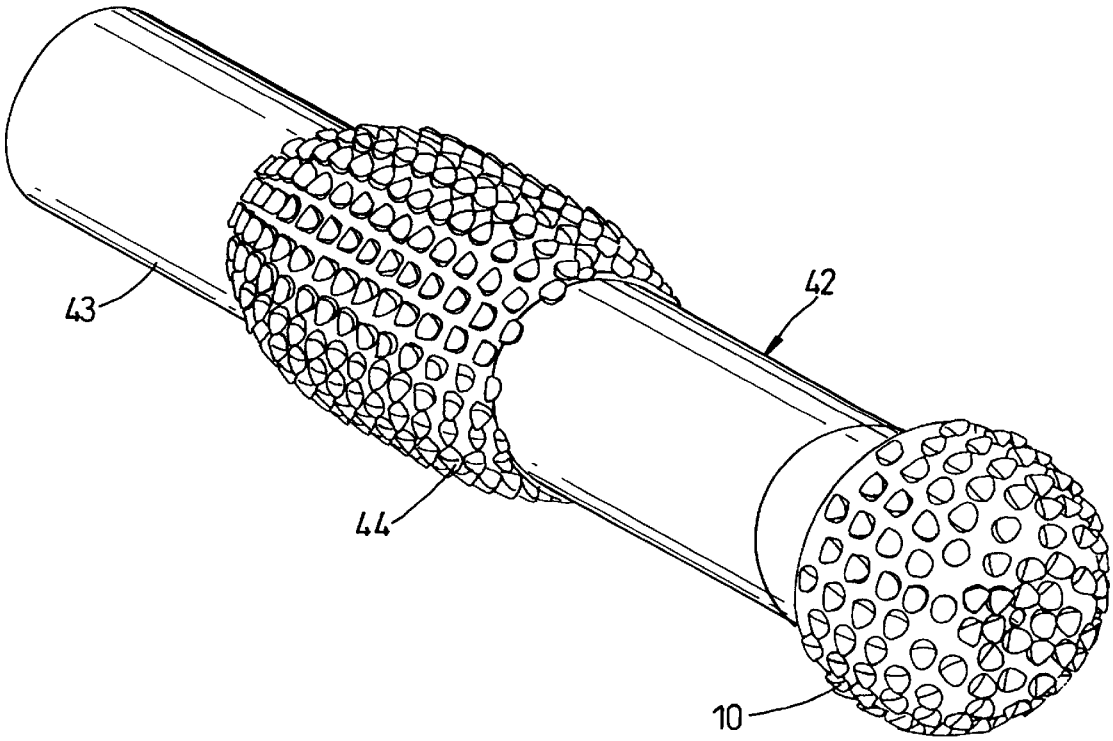
FIG. 4 is a perspective view of a wellbore milling system according to the present invention.
Figure 5A:
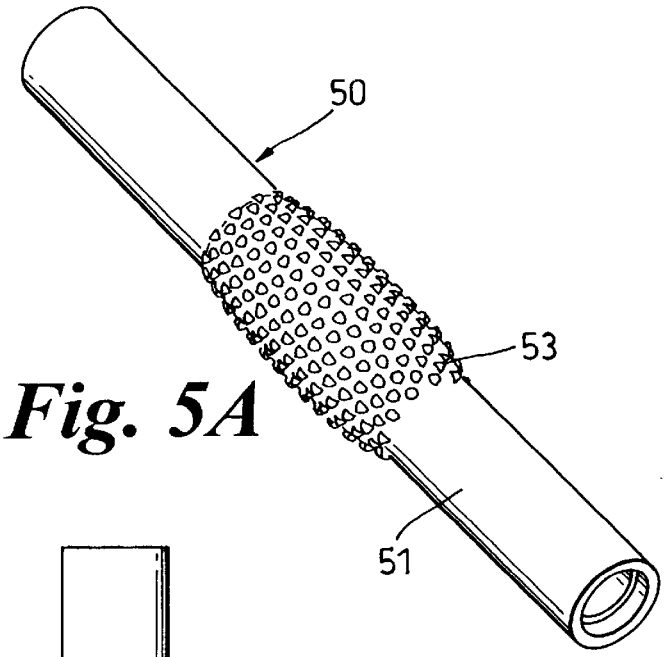
FIG. 5A is a perspective view of a watermelon mill according to the present invention.
Figure 5B:
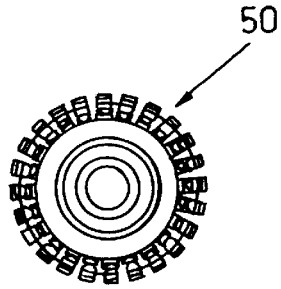
FIG. 5B is an end view, FIG. 5C a side view, and FIG. 5D a side cross-section view of the mill of FIG. 5A.
Figure 5C:
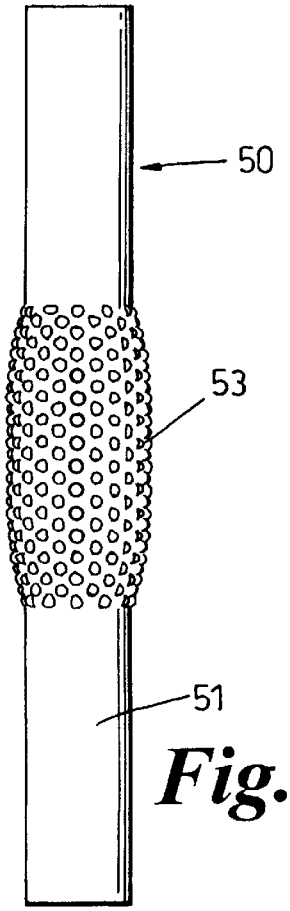
Figure 5D:
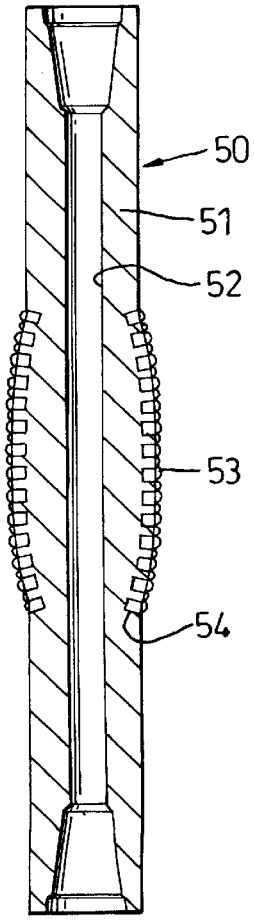

FIG. 4 shows a mill apparatus 42 according to the present invention with a tubular member 43 having a watermelon mill 44 according to the present invention and a mill 10 as described above. In one aspect the watermelon mill 44 is sized, configured and located so that it will ream a hole made by the mill 10. In one aspect such a watermelon mill 44 reams such a hole to gauge. In one aspect such a watermelon mill 44 may also lengthen a window made by the mill 10.

FIGS. 5A–5D show a watermelon mill 50 according to the present invention (like the watermelon mill 44) with a tubular body 51 having a fluid flow bore 52 running therethrough from top to bottom. A plurality of milling inserts 53 are secured to corresponding recesses 54. Any insert disclosed herein may be used, installed and secured by any method disclosed herein in the mill 50. In one aspect, the inserts 53 are secured in place mechanically, e.g. with a press fit only, without welding or brazing (as may be the inserts in the mills of FIGS. 1A, 3A, 4, 6A, 7A, 8, 9, 10, 11A and 12). The inserts 53 may be (as may the inserts of other mills disclosed herein) any known suitable insert, including, but not limited to, inserts as shown in FIGS. 1A, 1E and 1H–1M, installed and secured by any method described herein).

Figure 6A:
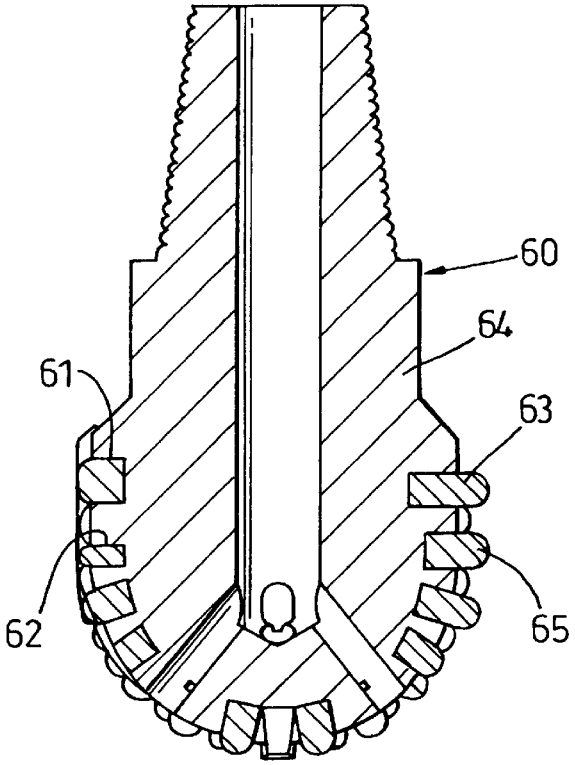
FIG. 6A is a side cross-section view of a mill according to the present invention.

FIG. 6A shows a mill 60 according to the present invention which is similar to the mill 10 in all respects; except a variety of different inserts are used. This illustrates that in any mill disclosed herein, different inserts may be used on one mill, including, but not limited to one or more inserts differing in: length; shape; amount of projection beyond a mill surface; and/or diameter. For example, the insert 61 is wider in diameter than an insert 26 (FIG. 1E); an insert 62 is smaller in diameter than inserts 26 and 61; an insert 63 is longer than an insert 26 and 61; the insert 63 projects further into a mill body 64 than does an insert 26 shown in FIG. 1E; and inserts 62 and 65 project further out from the mill body 64 than do inserts 26 and 28 from their respective mill body. Of course, corresponding recesses in the mill body are provided for each insert. The inserts may be any as described herein and installed and secured by any method described herein.

Figure 6B:
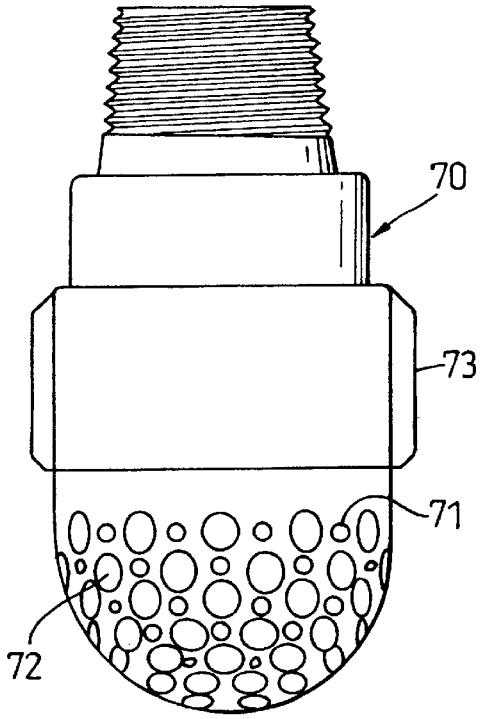
FIG. 6B is a side cross-section view of a mill according to the present invention.

FIG. 6B shows a mill 70 according to the present invention, like the mill 30 of FIG. 3A, but with a variety of insert recesses that includes recesses 71 for inserts smaller than inserts for the recesses 72 (which correspond to the recesses 39, FIG. 3A). The mill 70 has an optional gauge ring 73 like the ring 31, FIG. 3A. Any mill disclosed herein may use recesses of different sizes for corresponding inserts of different sizes. In one aspect, with inserts with a generally cylindrical body, the recesses have a generally circular shape to correspond to the shape of the insert body. It is within the scope of this invention to use any suitable known insert of any known shape (and correspondingly shaped recess), including, but not limited to square, rectangular, triangular, parallelogram, elliptical, oval and trapezoidal.

Figure 7A:
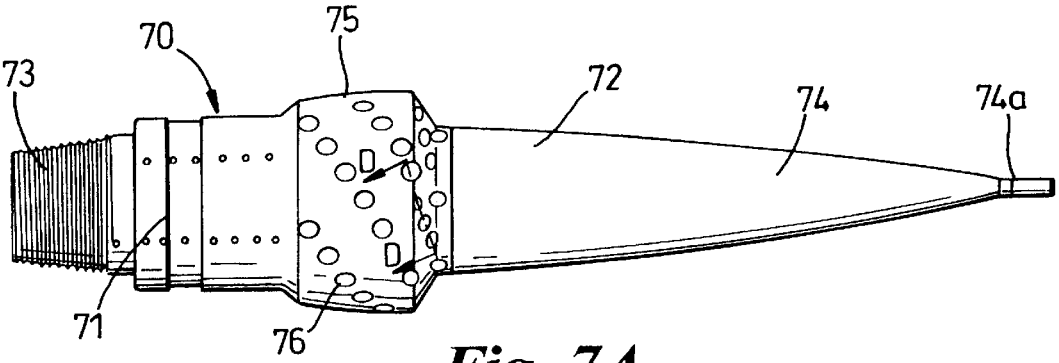
FIG. 7A is a side view of a mill according to the present invention.
Figure 7B:
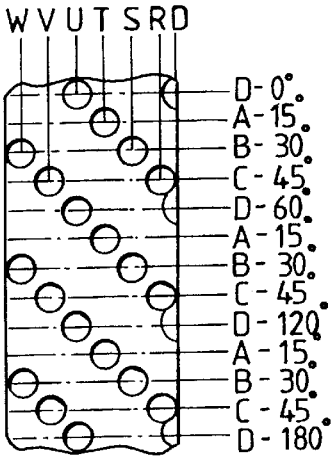
FIG. 7B is a partial side view of the mill of FIG. 7A.
Figure 7C:
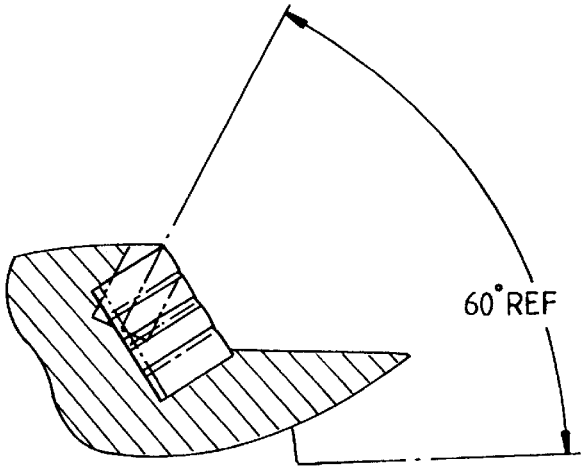
FIG. 7C is a side view along line 7C—7C of FIG. 7D.
Figure 7D:
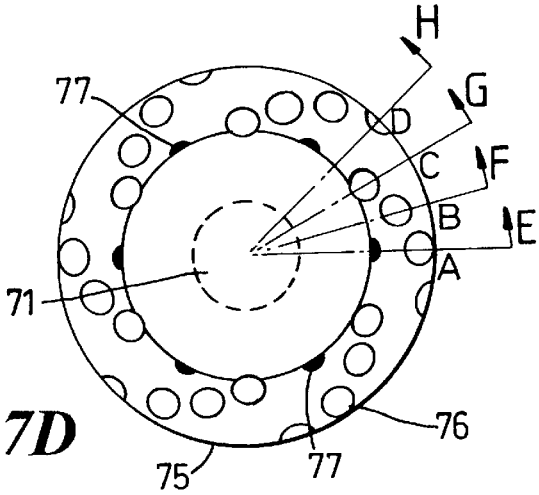
FIG. 7D is a cross-section view along line 7D—7D of FIG. 7A.
Figure 7E:
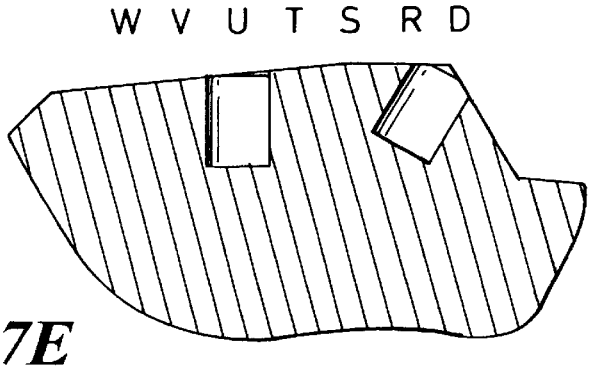
FIGS. 7E–7H are cross-section views at the corresponding points indicated in FIG. 7D.
Figure 7F:
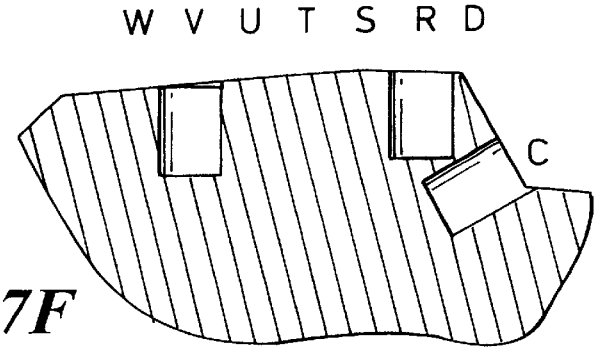
Figure 7G:
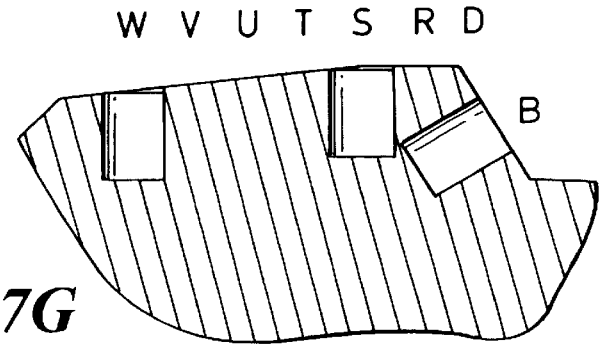
Figure 7H:
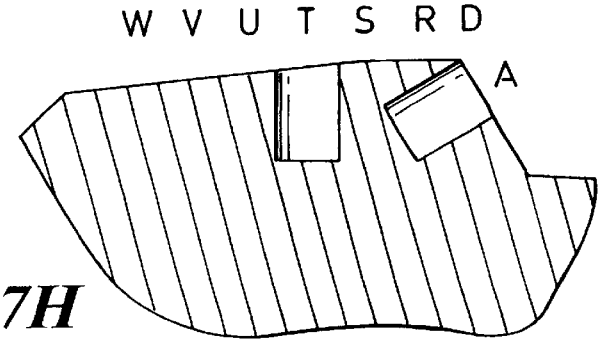

FIG. 7A shows a starting mill 70 according to the present invention. The mill 70 has a tubular body 72 with a fluid flow bore 71 therethrough extending down from a threaded top end 73. A mill body 75 has a plurality of milling inserts (not shown) in a corresponding plurality of recesses 76. The body 72 has a typical bottom end 74 with a hole 74*a* for a shear stud. FIGS. 7B–7H illustrate one possible pattern for the recesses 76 and the corresponding inserts. There are six side rows of inserts—labelled W, V, U, T, S, R—600 apart. (Three, four, five, seven or any desired number of rows may be used.) End or bottom inserts are in recesses or holes A, B, C, and D. Recesses or "holes" "D" are 60° from a mill axis as shown in FIG. 7C. Recesses or "holes" "A," "B," and "C" are 30° from this axis (see FIGS. 7F–7H). Each set or pattern of "holes" A, B, C and D are offset 15° from each other. Blackened semi-circles in FIG. 7D indicate fluid flow holes 77 in fluid communication with a flow bore 78. "Hole A to be inline with port" means that the Hole A is lined up with a fluid flow hole. For clarity, some holes are not shown in FIGS. 7E–7H.

Figure 8:
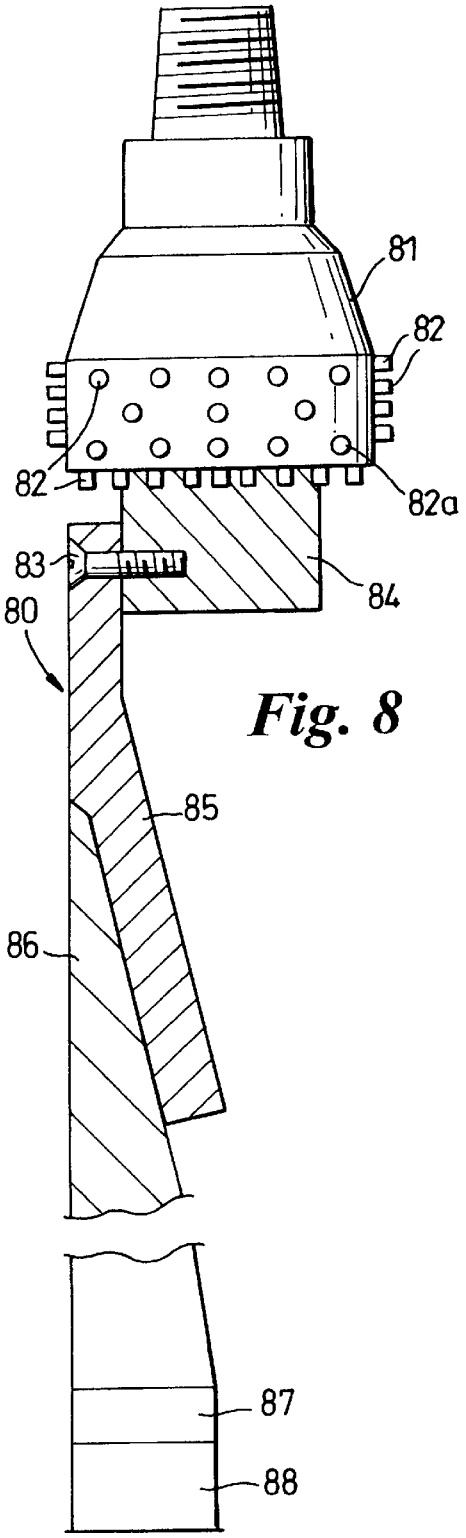
FIG. 8 is a side view partially in cross-section of a milling system according to the present invention.

FIG. 8 shows a mill apparatus 80 according to the present invention with a mill 81 having inserts 82 and 82*a* like any inserts disclosed above. A shear pin 83 releasably holds a mill pilot end 84 to an upper member 85 of a whipstock 86. Optionally an orienting apparatus 87 (shown schematically) is connected to the whipstock 86 for properly positioning the whipstock in a wellbore. Also optionally, an anchor apparatus 88 is connected to the whipstock (and/or to the orienting apparatus 87) for selectively anchoring the apparatus 80 in a wellbore or in a tubular in a wellbore. Optionally, the whipstock, orienting apparatus, and anchoring apparatus may be "through-tubing" devices for use in wellbore through-tubing operations. Also, the apparatus 80 may be used in a "single trip" window milling operations (as may any mill disclosed herein appropriately releasably secured to a whipstock etc.).

Figure 9:
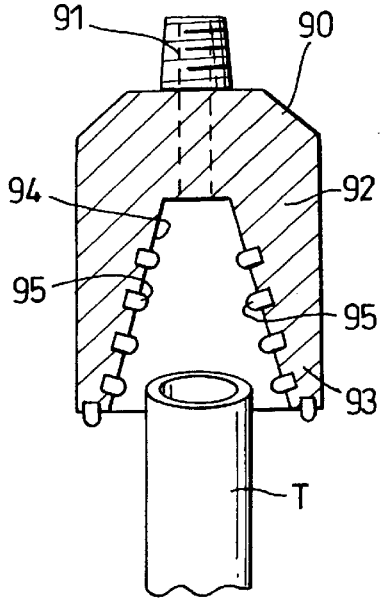
FIG. 9 is a side view in cross-section of a mill according to the present invention.

FIG. 9 shows a mill 90 according to the present invention with a mill body 92 having a top threaded end 91. A lower end 93 has a concave recess 94 with an array of inserts 95. The shape of the recess 94 allows the mill to hold milled material, e.g. but not limited to cuttings from a window milling operation or from milling a tubular T, and to retain what is milled material. This mill may be used, e.g., for milling over or through a tubular in a wellbore. The recess 94 may be any concave, recessed, inverted or conical shape.

Figure 10:
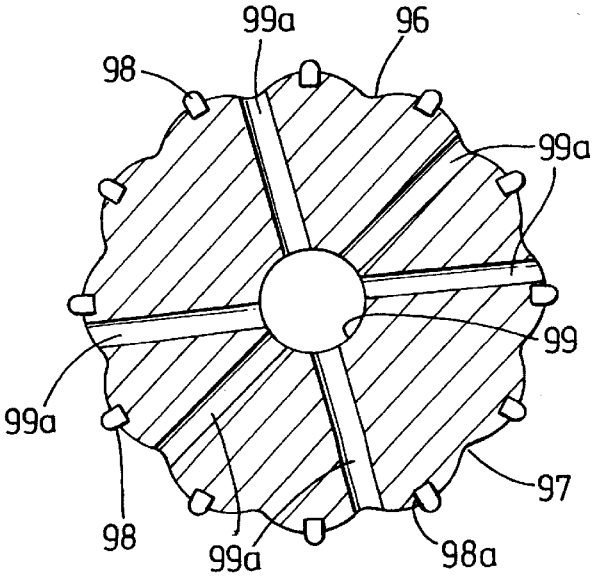
FIG. 10 is a mid cross-section view of a mill according to the present invention.

FIG. 10 discloses a shape for a mill body 96 with a wavy or scalloped outer surface 97 which may be used to enhance mechanical support of inserts on the projecting body portions and to enhance fluid flow in the valleys therebetween for any mill disclosed herein. In one aspect inserts 98 (as any disclosed herein) are located in the projecting body portions as shown in FIG. 10. Optionally inserts as inserts 98*a* may be used in any or all of the valleys. Optionally inserts in the valleys or on the projections may be deleted. An optional flow bore 99 extends through the body 96 to optional flow ports 99*a*. Any suitable inserts and corresponding recesses (as described herein) may be used. Such a scalloped surface may be used for any mill body disclosed herein.

Figure 11A:
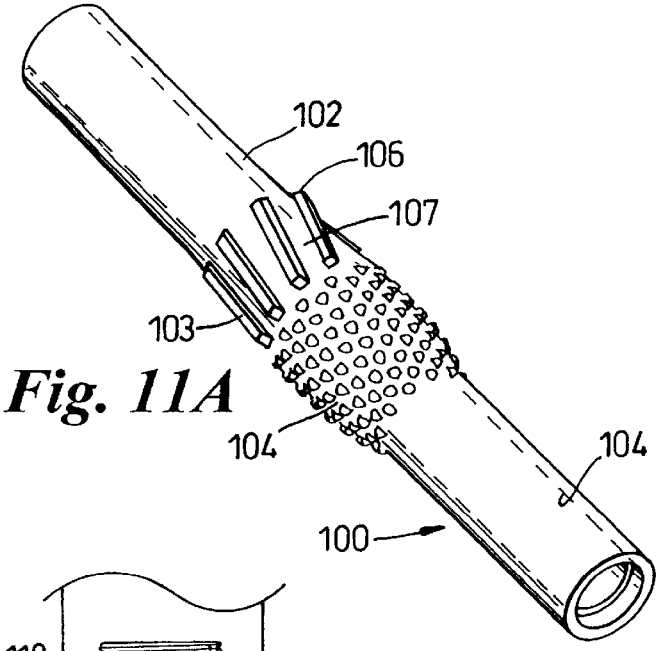
FIGS. 11A is a perspective view and FIG. 11B is a side view of a mill according to the present invention.
Figure 11B:
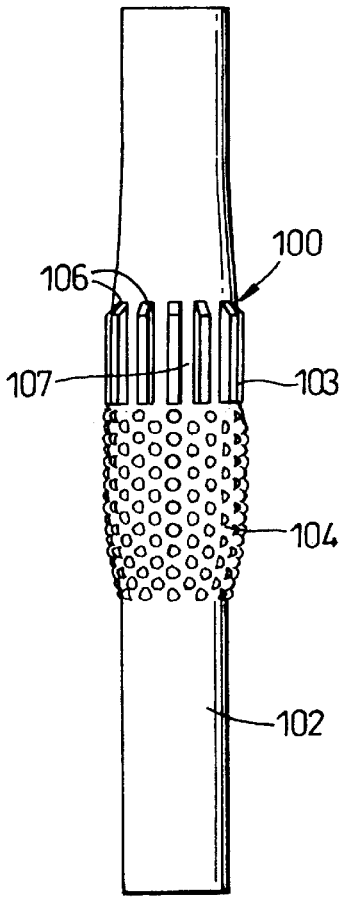

FIGS. 11A–11B shows a mill 100 with a tubular body 102 having a flow bore 104 therethrough. A gauge ring 103 (with spaced apart projections or helical blades) is secured to or formed of the body 102. An array of milling inserts 104, as any inserts disclosed herein are secured in corresponding recesses on the body 102 (and/or on blades of the ring 103) using any securement method described herein. A tapered end 106 of the projections or blades of the gauge ring 103 facilitates mill movement through tight spots in a string. A tapered end may be provided on either end of the mill body to enhance mill movement either going into or coming out of a wellbore. Spaces 107 between ring parts facilitate fluid flow.

Figure 12A:
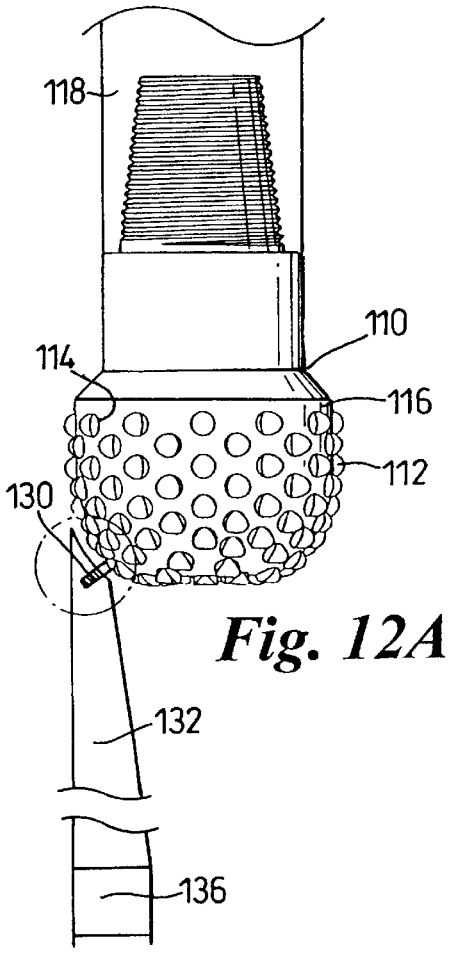
FIG. 12A is a side view of a milling system according to the present invention.
Figure 12B:
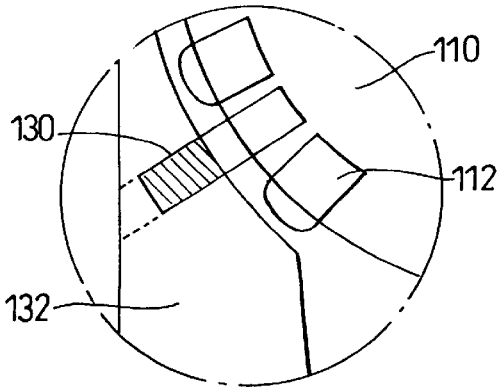
FIG. 12B presents an enlargement of a portion of the milling system of FIG. 12A.

FIGS. 12A and 12B show a mill 110 according to the present invention with inserts 112 secured in corresponding recesses 114 on a mill body 116 which is connected to a tubular string 118 (shown partially). A shear pin 130 releasably holds the mill 110 to a whipstock 132. Optionally, an anchor device 134 (shown schematically) is connected to the whipstock 132 (any suitable known anchor apparatus). In a typical single-trip operation with such a mill 110 with an anchor 134, the mill is tripped into a wellbore; the whipstock is properly oriented with (optional) orienting apparatus 136 (shown schematically connected to the anchor or, optionally, to the whipstock) and the anchor is set; the pin 130 is sheared, freeing the mill; and milling commences by rotating the string 118 from the surface or downhole with a downhole motor (as may be done with any mill disclosed herein). Such a system may be a "thru-tubing" system (with a thru-tubing anchor device) and/or a "milling/drilling" system and any system disclosed herein may have such thru-tubing and/or milling-drilling devices and apparatuses.

With respect to any insert described herein, the mechanical securement of the insert in a corresponding recess or hole greatly facilitates replacement of a worn or broken insert since in cases in which there is no brazing or welding, no weld material or braze material needs to be dealt with. In certain cases according to this invention in which some weld or braze material is used it is significantly less than the amount of weld or braze material used in prior art devices and insert removal and replacement is much easier.

Figure 13:
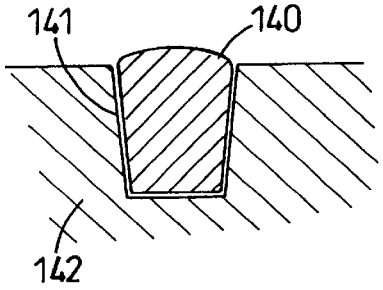
FIG. 13 is a side cross-section view of a mill body (or mill blade or structure), shown partially, and an insert in a recess of the body, according to the present invention.

FIG. 13 shows an insert 140 according to the present invention in a recess 141 in a mill body (blade, structure, and/or bulb, etc.) 142. The insert 140 is generally cylindrical and tapers from a top wider portion to a lower narrower portion, as does the recess 141 that corresponds in shape to the tapered shape of the insert 140. Any mechanical securement disclosed herein may be used to secure the insert 140 in the recess 141. In other aspects, such securement is used with known welding or brazing techniques. Any insert disclosed herein may be provided with such a taper.

Figure 14:
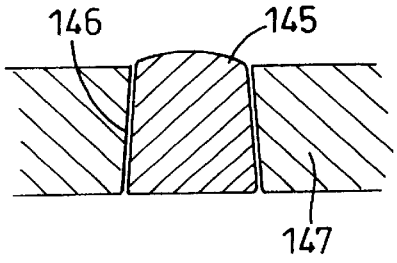
FIG. 14 is a side cross-section view of a mill body (or mill blade or structure), shown partially, and an insert in a recess of the body, according to the present invention.

FIG. 14 shows an insert 145 in a hole 146 according to the present invention in a mill member 147 (body, blade, structure and/or bulb, etc.). The insert 145 tapers from a narrower portion at the top (as viewed in FIG. 14) to a wider portion at the bottom (as viewed in FIG. 14). Any mechanical securement disclosed herein may be used to secure the insert 145 in the recess 146. In other aspects, such securement is used with known welding or brazing techniques. Any insert disclosed herein may be provided with such a taper.

Figure 15:
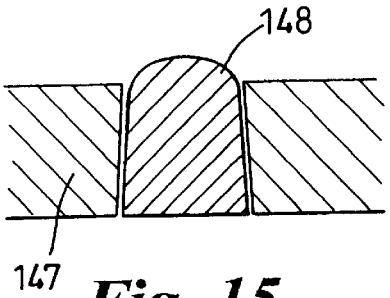
FIG. 15 is a side cross-section view of an insert in a hole in a mill body (or mill blade or structure), shown partially, and an insert in a recess of the body, according to the present invention.

FIG. 15 shows an insert 148 like the insert 145 in the member 147, but the insert is like the inserts 26 and has two edge portions disposed below (as viewed in FIG. 17) an upper surface of the member 147.

Figure 16:
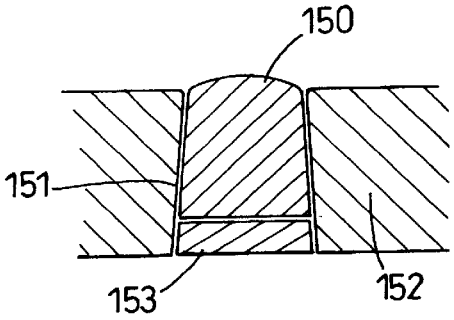
FIG. 16 is a side cross-section view of an insert in a hole in a mill body (or mill blade or structure), shown partially, and an insert in a recess of the body, according to the present invention.

FIG. 16 shows an insert 150 according to the present invention in a recess 151 in a mill member 152. A washer or plug 153 enhances securement of the insert 150 in the recess 151. The insert 150 and/or plug 153 may be threaded to threadedly mate with corresponding threads on the interior of the recess 151. Additionally or alternatively, any other mechanical securement disclosed herein may be used. In other aspects welding or brazing is also employed to secure the insert 150 and/or plug 153 in place.

Figure 17:
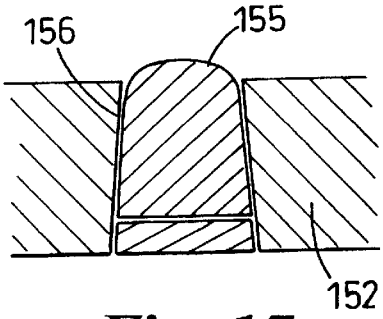
FIG. 17 is a side cross-section view of an insert in a hole in a mill body (or mill blade or structure), shown partially, and an insert in a recess of the body, according to the present invention.

FIG. 17 shows an insert 155, like the insert 150, in a recess 156 in the member 152; but (as with the insert/securement shown in FIG. 15) the insert 155 has two edges disposed beneath (as viewed in FIG. 17) a top surface of the member 152. The inserts shown in FIGS. 13–24 may have any shape and/or configuration (e.g. square, triangular, etc. as viewed from above) disclosed herein.

Figure 18A:
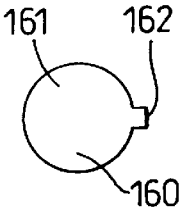
FIG. 18A is a top view of an insert according to the present invention.
Figure 18B:
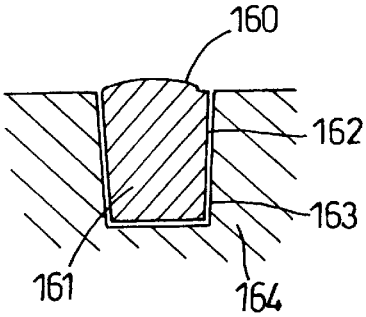
FIG. 18B is a side cross-section view of the insert of FIG. 18A in a recess in a mill body (or mill blade or structure), shown partially, and an insert in a recess of the body, according to the present invention.
Figure 19:
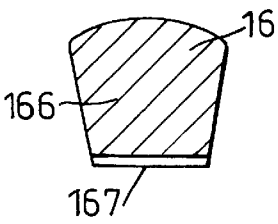
FIG. 19 is a side cross-section view of an insert according to the present invention.

FIG. 18A shows an insert 160 according to the present invention which has a generally cylindrical tapered body 161 with a projecting tab 162. This tab 12 may be used for proper positioning and alignment of an insert in a recess 163 in a mill member 164, as shown in FIG. 18B. Any insert disclosed herein may have one or more such tabs. Any mechanical securement disclosed herein may be used with the insert 160. In one particular aspect the tab 162 is made of energy dissipating material FIG. 19 shows an insert 165 according to the present invention with a generally cylindrical tapered body 166 and with an energy dissipating member 167 secured thereto or formed thereof. The member 167 is made of energy dissipating material.

Figure 20A:
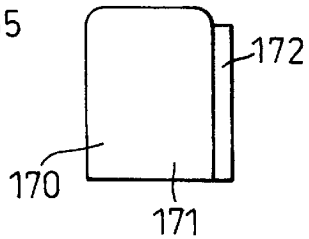
FIG. 20A is a top view of an insert according to the present invention.
Figure 20B:
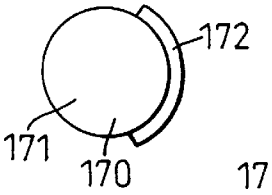
FIG. 20B is a top view of the insert of FIG. 20A.

FIGS. 20A and 20B show an insert 170 according to the present invention with a generally cylindrical body 171 and an energy dissipating member 172 secured thereto or formed thereof. The member 172 is made of energy dissipating material. Any insert disclosed herein may have one or more members 172 spaced therearound. In one aspect the entire circumference or periphery of an insert is encompassed by a member 172.

Figure 21A:
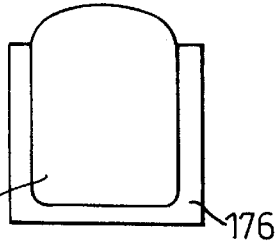
FIG. 21A is a top view of an insert according to the present invention.
Figure 21B:
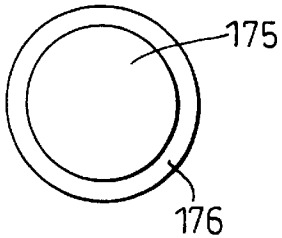
FIG. 21B is a top view of the insert of FIG. 21A.

FIGS. 21A and 21B show an insert 175 according to the present invention whose side surface or surfaces and whose bottom surface is encapsulated in an energy dissipating member 176 made of energy dissipating material secured to or formed of the insert 175. Any insert disclosed herein may be so encapsulated. Such encapsulation (and any energy dissipating structure or member disclosed herein) may be a desired thickness for achieving desired energy dissipation while also achieving desired mechanical securement in a hole or recess.

Figure 22:
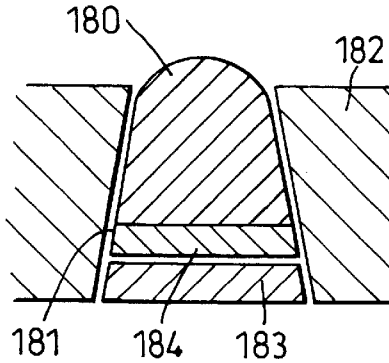
FIG. 22 is a side cross-section view of an insert in a hole in a mill body (or mill blade or structure), shown partially, and an insert in a recess of the body, according to the present invention.

FIG. 22 shows an insert 180 according to the present invention like the insert of FIG. 17, in a recess 181 in a mill member 182 held in place by a plug 183. An energy dissipating member 184 is emplaced between the plug 183 and the bottom end of the insert 180. All three or any of the pieces 180, 1813, 184 may be threaded to threadedly mate with threads in the interior of the recess 181. Such a member 184 may be used with any insert disclosed herein.

Figure 23A:
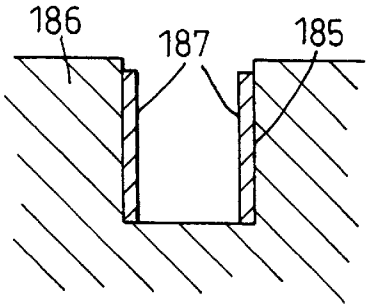
FIG. 23A is a side cross-section view of a recess for an insert in a mill body (or mill blade or structure), shown partially, and an insert in a recess of the body, according to the present invention.
Figure 23B:
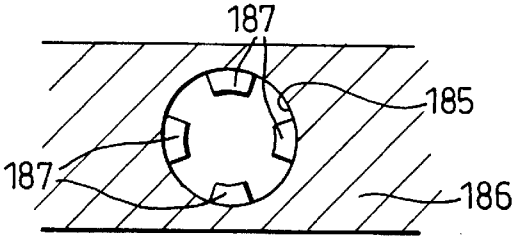
FIG. 23B is a top view of the recess of FIG. 23A.

FIGS. 23A and 23B show a recess 185 according to the present invention in a mill member 186. A plurality of energy dissipating members 187 are spaced-apart around the recess 185. The members 187 are made of energy dissipating material secured to or formed of the recess's interior. Any recess disclosed herein may be provided with one or more of the members 187.

Figure 24:
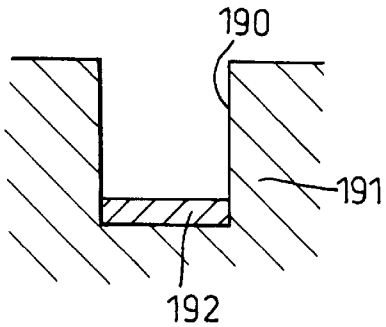
FIG. 24 is a side cross-section view of a recess for an insert in a mill body (or mill blade or structure), shown partially, and an insert in a recess of the body, according to the present invention.

FIG. 24 shows a recess 190 according to the present invention in a mill member 191. An energy dissipating member 192 is placed in, secured in, or formed of the recess 190. The energy dissipating member 192 is shaped to cover the entire bottom of the recess 190. Alternatively, it may have one or more holes or openings through it and/or one or more indented portions.

Figure 25A:
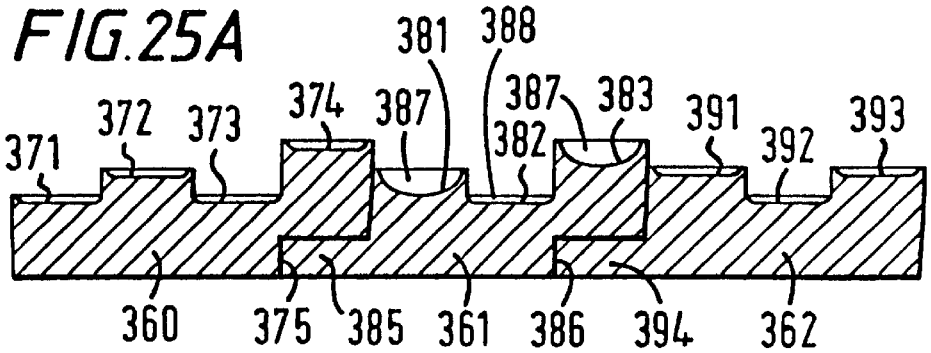
FIG. 25A is a side view of an insert array according to the present invention.

FIG. 25A shows inserts 360, 361, and 362 in an array according to the present invention. The insert 360 has four top milling surfaces 371, 372, 373, 374 and a step receiving recess 375. The insert 361 has three top milling surfaces 381, 382, 383, and 384 each with a chipbreaker indentation; a step member 385; and a step receiving recess 386. The insert 361 has different depth chipbreakers 387 and 388 in its milling surfaces and all milling surfaces are at different levels. The step member 385 is positioned in the step receiving recess 375 of the insert 360. The milling insert 362 has three milling surfaces 391, 392, 393 each with a chipbreaker indentation and a step member 394 that is positioned in the step receiving recess 386 of the insert 361. The insert 361 may be deleted from the pattern of FIG. 25A. Alternatively, multiple inserts 361 may be used.

It is within the scope of this invention to provide a step member on any insert and a step receiving recess on any insert disclosed herein. It is within the scope of this invention for the step member to be at any level on the insert (as viewed from the side in FIG. 25A); to be on any side of the insert; and for a step receiving recess to be anywhere on an insert suitable for positioning therein of a step member. Also the extent of the step (side-to-side in FIG. 25A) may be any desired length with a corresponding step receiving recess. The step members may extend across the entire width of an insert or only partially across. Any step member may have a chipbreaking indentation or part thereof.

Figure 25B:
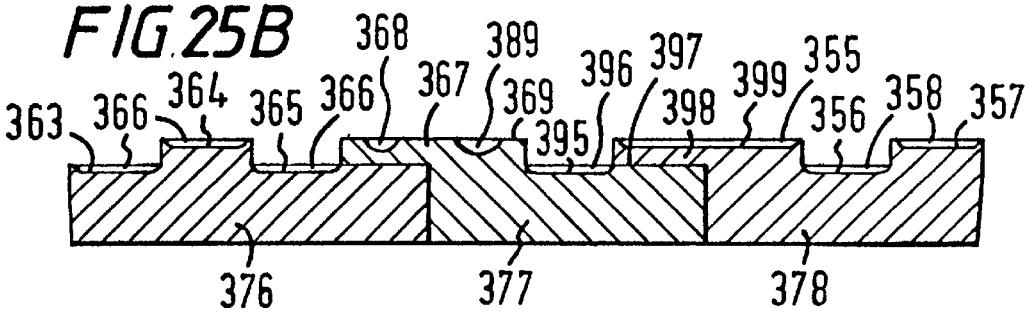
FIG. 25B is a side view of an insert array according to the present invention.

FIG. 25B shows inserts 376, 377 and 378 in an array according to the present invention. The insert 376 has milling surfaces 363, 364, and 365 each with a chipbreaker 366. The insert 377 has a step member 367 with a chipbreaker indentation 368; a milling surface 369 with a chipbreaker indentation 389; a milling surface 395 with a chipbreaker indentation 396; and a step surface 397 over which a step member is positionable. The insert 378 has a step member 398 that overlies the step surface 397; a milling surface 399; a chipbreaker 355 on the step member 398 and on the milling surface 399; a milling surface 356; a milling surface 357; and chipbreakers 358.

Figure 26A:
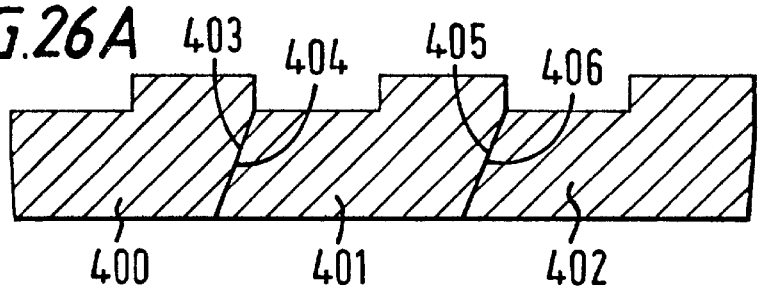
FIG. 26A is a side view of an insert array according to the present invention.

FIG. 26A shows (side view) an insert 400, an inset 401, and an insert 402, all according to the present invention. Each insert has two top milling surfaces. The insert 400 has a tapered or canted end 403. The insert 401 has a front end 404 that is angled to correspond to and be positioned under the canted end 403 of the insert 400. The insert 401 has a canted end 405. The insert 402 has a front end 406 that is angled to correspond to and be positioned under the end 405 of the insert 401. Each insert has two top milling surfaces, but it is within the scope of this invention for there to be one, three, four or more such surfaces with or without one or more chipbreakers.

Figure 26B:
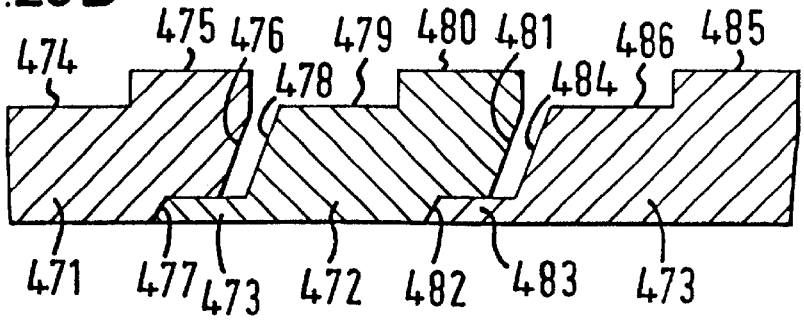
FIG. 26B is a side view of an insert array according to the present invention.

FIG. 26B shows inserts 471, 472 and 473 in an array according to the present invention. The insert 471 has a milling surface 474; a milling surface 475; a tapered end 476; and a step recess 477. The insert 472 has a step 473 part of which is in the step recess 477; a tapered end 478; a milling surface 479; a milling surface 480; a tapered end 481 and a step recess 482. The milling insert 473 has a step 483 part of which is in the step recess 482; a tapered end 484; a milling surface 488; and a milling surface 486. By appropriate sizing of the step recesses and the steps, the spacing between the inserts is determined (or abutment of two inserts).

Inserts according to the present invention as in FIG. 26B may have one, three, four or more milling surfaces with or without one or more chipbreakers. With respect to the inserts of FIG. 26B (and any spaced-apart inserts disclosed herein) steps, recesses, and/or tabs may be used to achieve desired spacing and matrix material and/or milling matrix material and/or energy dissipating material may be emplaced in any space between inserts. Steps, tabs, and/or recesses may be made of metal or any suitable energy dissipating material and may be used to achieve proper arrangement, alignment, and orientation (one insert with respect to another as well as various rake angles) of inserts on milling bodies or on milling blades. Inserts disclosed herein may be applied by any known application method in any known combination, pattern, array or arrangement.

Figure 27A:
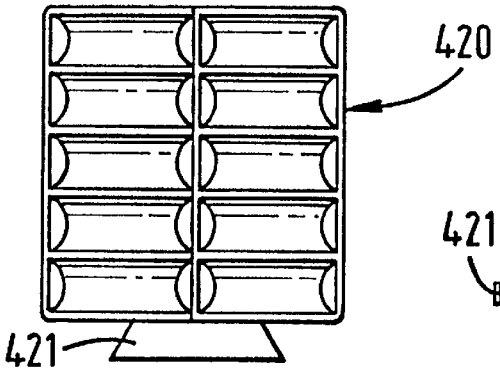
FIG. 27A is a top view of an insert according to the present invention.
Figure 27B:
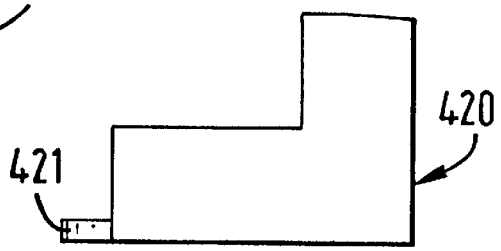
FIG. 27B is a side view of the insert of FIG. 27A.

FIGS. 27A and 27B show an insert 420 like the insert 300 described above, but with a positioning tab 421 projecting from one of its sides. The insert 420 with the tab 421 to space the insert 420 apart from another insert with the tab 421 abutting the other insert. Alternatively, the tab 421 may be positioned in a corresponding recess of another insert or in a mill member, either with a tight fit or a loose fit, depending on abutment or spacing desired between inserts.

Figure 27C:
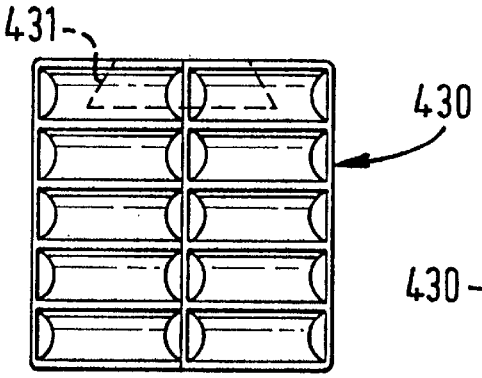
FIG. 27C is a top view of an insert according to the present invention.
Figure 27D:
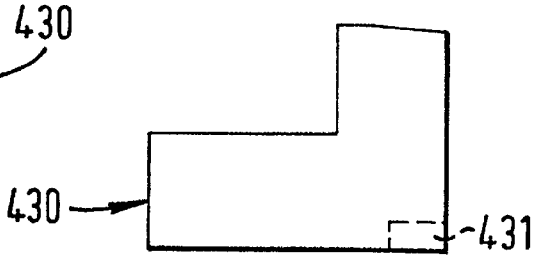
FIG. 27D is a cross-section view along line 27D—27D of FIG. 27C.
Figure 27E:
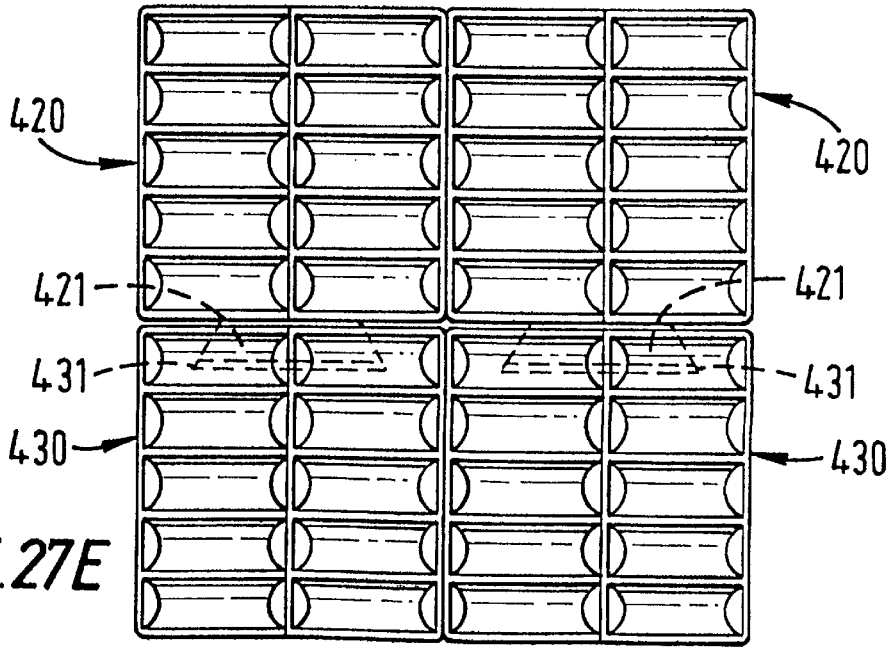
FIG. 27E is a top view of an array with inserts of FIGS. 27A–27D.

FIGS. 27C and 27D show an insert 430 with a tab insert recess 431 for receiving a tab like the tab 421 of the insert 420. FIG. 27E shows an array of inserts 420 and 430.

Figure 28A:
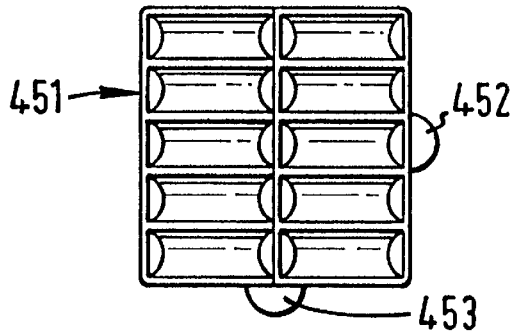
FIG. 28A is a top view of an insert array according to the present invention.
Figure 28B:
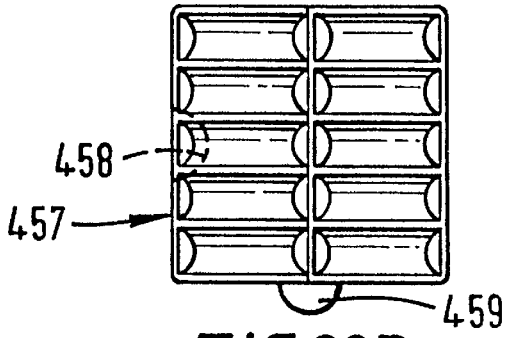
FIG. 28B is a top view of an insert array according to the present invention.
Figure 28C:
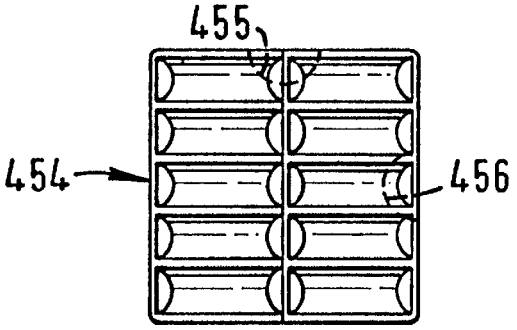
FIG. 28C is a top view of an insert according to the present invention.
Figure 28D:
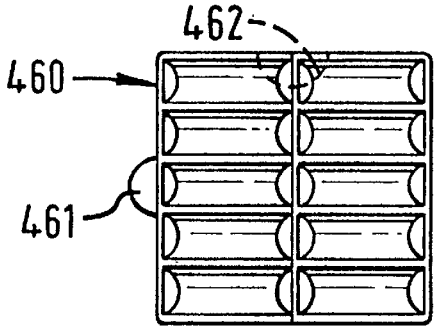
FIG. 28D is a top view of an insert according to the present invention.
Figure 28E:
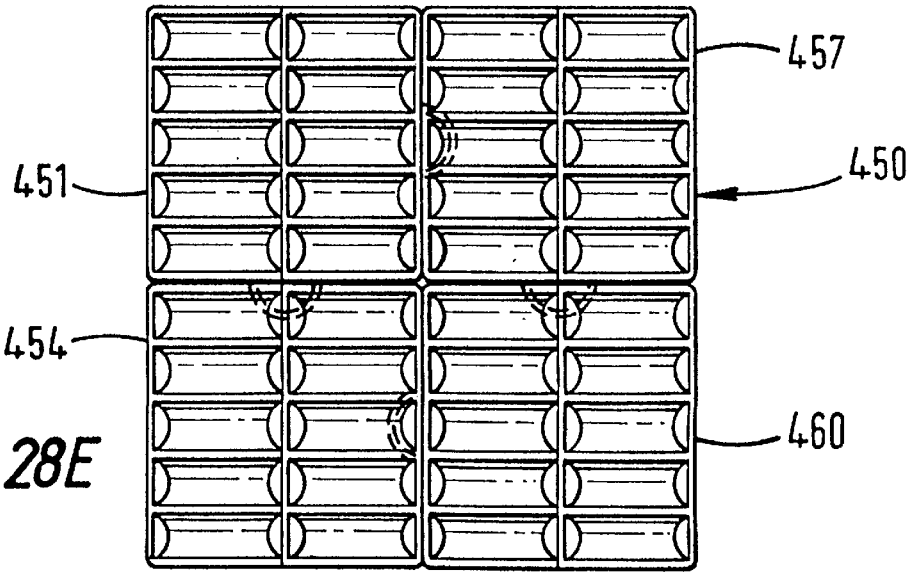
FIG. 28E is a top view of an insert according to the present invention.

It is within the scope of this invention to provide any insert disclosed herein (above or below) with one or more steps or tabs of any desired shape (half circle, square, rectangular, triangular, half oval, trapezoidal, etc.) and inserts with recesses shaped to receive such steps or tabs or part thereof. It is within the scope of this invention to provide any insert disclosed herein with a step or tab on one, two, three or four sides (or for a non-straight sided insert to provide one or more steps or tabs on a curved surface thereof) and corresponding inserts with a corresponding recess or recesses. Thus, in one aspect, an array of interlinked inserts is provided, such as the array 450 of FIG. 28A that includes an insert 451 (FIG. 28B) with tabs 452 and 453; an insert 454 (FIG. 28C) with tab recesses 455, 456; an insert 457 (FIG. 28D) with a tab recess 458 and a tab 459; and an insert 460 (FIG. 28E) with a tab 461 and a tab recess 462. A minimum space is shown between inserts in the array 450, but any desired spacing may be employed or the inserts (or any pair of inserts or group) may abut each other. In certain embodiments a plurality of inserts are used adjacent each other and it is not desirable for the breaking of one insert to result in the breaking of an adjacent insert. It is within the scope of this invention to use a step or tab of such a thickness that it provides the desired interlinking and/or insert-to-insert spacing, but is sufficiently weak that the step or tab breaks in response to force on an adjacent insert without the breaking of the insert with the step or tab. In other aspects, the step or tab (instead of or in addition to reduced thickness) may have a weakening groove, cut, or indentation (which may or may not be one or more chipbreakers). For example, and without limitation, the chipbreaker indentation 368 of the step member 367 (FIG. 25B) may be of sufficient size to render the step member a "breakaway" member if force applied to the insert 376 is sufficient to break the insert 376.

The present invention discloses, in certain aspects and embodiments a wellbore mill with a body having a top and a bottom, and milling apparatus on the body including a plurality of milling inserts, each insert secured mechanically in a corresponding recess in the body, the mechanical securement sufficient for effective milling of an opening through a tubular in a wellbore. Such a mill may have one, some, or all of the following: wherein the inserts are mechanically secured in the recesses by a method from the group consisting of adhesive epoxying, press fit, friction fit, and heat-shrink fit; for each insert of the plurality of milling inserts, a screw extending through the body and into each insert for releasably securing each insert in a corresponding recess; each insert having a taper from one end to the other and each recess having a corresponding taper; wherein each insert of the plurality of milling inserts has a generally cylindrical body with a top that is round as viewed from above, the top having a mid-portion and two spaced-apart side portions, the spaced apart side portions extending downwardly below the mid-portion of the top; wherein the recess for each insert is sized and configured so that outer edges of the two side portions of the insert are disposed below an upper edge of the recess in which the insert is secured; a fluid flow channel extending through the body from the top down to one or more jet ports and/or from top to bottom, and, in some aspects, at least one fluid flow port at the bottom of the body in fluid communication with the fluid flow channel; at least one milling insert aligned with an exit opening of the at least one fluid flow port for milling an area passed over by the at least one fluid flow port; wherein the at least one fluid flow port is positioned off center with respect to a central longitudinal axis of the body; a gauge ring on the body spaced-apart from the milling inserts; wherein the gauge ring is a series of spaced-apart projections extending outwardly from the body; wherein the body has a central indented portion in the bottom thereof; a whipstock selectively releasably connected to the body of the wellbore mill; an anchor apparatus connected to the whipstock for selectively anchoring the whipstock in a wellbore or in a tubular in a wellbore; wherein the body has a lower portion with a stepped configuration as viewed from a side; orienting apparatus connected to the whipstock for orienting the whipstock; wherein the whipstock is a through-tubing whipstock; wherein the anchor apparatus is a through-tubing anchor apparatus; wherein the body has a scalloped cross-section defined by a series of alternating projections and valleys; wherein at least some of the plurality of milling inserts are disposed in at least some of the projections; wherein the mill is a window mill; the mill or mills in combination with a watermelon mill spaced-apart therefrom; wherein the mill is a watermelon mill; and/or wherein each insert is also secured in a recess by welding or brazing.

The present invention discloses, in certain aspects and embodiments a mill body for a wellbore mill, the mill body including a body member, at least one opening in the body member for holding a milling insert, and energy dissipating structure in the at least one opening for dissipating energy imposed on an insert in the at least one recess; wherein the energy dissipating structure is secured to or formed of an interior of the at least one opening; an insert held in the at least one opening and wherein the energy dissipating structure is on an insert; wherein the energy dissipating structure is an energy dissipating member emplaced into the at least one opening; a removable plug removably disposed within the at least one opening for holding an insert therein; wherein the at least one opening comprises a hole through the body member; wherein the at least one opening comprises a recess in the mill body; and/or wherein the energy dissipating structure is an energy dissipating member on a bottom of the recess.

The present invention discloses, in certain aspects and embodiments a milling insert for use with a wellbore mill, the wellbore mill having a mill body with an opening for receiving the milling insert, the milling insert having an insert body, and at least one energy dissipating member on the insert body; wherein the at least one energy dissipating member is a series of spaced-apart members on an outer surface of the milling insert; and/or wherein the at least one energy dissipating member encapsulates a portion of the milling insert.

The present invention discloses, in certain aspects and embodiments a wellbore milling method for milling an opening in a selected tubular member of a tubular string in a wellbore, the method including installing a mill on a working string into the wellbore at a selected desired point for milling an opening in the selected tubular member, the mill like any disclosed herein, and rotating the mill to mill an opening in the selected tubular member; such a method may also include one, some, or all of the following: wherein the body has a fluid flow channel extending therethrough from top to bottom, the method further including creating a core of material of the selected tubular member by milling the selected tubular member, said core received into at least a lower end of the fluid flow channel, and separating with said mill said core from said selected tubular member; wherein the body of the mill has a whipstock selectively releasably connected thereto and an anchor apparatus is connected to the whipstock, the method including installing the mill on a working string into the wellbore further comprising activating the anchoring apparatus to anchor the mill and whipstock at a desired location in the tubular string, releasing the mill from the whipstock, and commencing milling of the selected tubular member; wherein the body of the mill has a whipstock selectively releasably connected thereto and an orientation apparatus is connected to the whipstock, the method including prior to milling the selected tubular member, orienting the whipstock to a desired position within the wellbore; and/or wherein the anchor apparatus is a through-tubing anchor apparatus and the whipstock is a through-tubing whipstock, the tubular string in the wellbore comprising a first string portion with a first inner diameter and a second string portion connected to and below the first string portion, the second string portion having an inner diameter greater than that of the first string portion, and the selected tubular member part of the second string portion, the method including prior to commencing milling, inserting the mill, whipstock, and anchor apparatus through the first string portion into the second string portion to a location adjacent the selected tubular member.

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A wellbore mill comprising a body having a top and a bottom, milling apparatus on the body, the milling apparatus comprising a plurality of milling inserts, each insert secured mechanically in a corresponding recess in the body, said mechanical securement sufficient for effective milling of an opening through a tubular in a wellbore, wherein each insert of the plurality of milling inserts has a generally cylindrical body with a top that is round as viewed from above, the top having a mid-portion and two spaced-apart side portions, the spaced apart side portions extending downwardly below the mid-portion of the top, wherein the recess for each insert is sized and configured so that outer edges of the two side portions of the insert are disposed below an upper edge of the recess in which the insert is secured.

2. The wellbore mill of claim 1 wherein the inserts are mechanically secured in the recesses by a method from the group consisting of adhesive epoxying, press fit, friction fit, and heat-shrink fit.

3. The wellbore mill of claim 1 further comprising each insert having a taper from one end to the other and each recess having a corresponding taper.

4. The wellbore mill of claim 1 further comprising a fluid flow channel extending through the body from top to bottom, at least one fluid flow port at the bottom of the body in fluid communication with the fluid flow channel.

5. The wellbore mill of claim 4 wherein at least one milling insert is aligned with an exit opening of the at least one fluid flow port for milling an area passed over by the at least one fluid flow port.

6. The wellbore mill of claim 4 wherein the at least one fluid flow port is positioned off center with respect to a central longitudinal axis of the body.

7. The wellbore mill of claim 1 further comprising a gauge ring on the body spaced-apart from the milling inserts.

8. The wellbore mill of claim 7 wherein the gauge ring comprises a series of spaced-apart projections extending outwardly from the body.

9. The wellbore mill of claim 1 wherein the body has a central indented portion in the bottom thereof.

10. The wellbore mill of claim 7 wherein the gauge ring comprises a series of spaced-apart projections extending outwardly from the body.

11. The wellbore mill of claim 1 further comprising a whipstock selectively releasably connected to the body of the wellbore mill.

12. The wellbore mill of claim 11 further comprising an anchor apparatus connected to the whipstock for selectively anchoring the whipstock in a wellbore or in a tubular in a wellbore.

13. The wellbore mill of claim 12 wherein the body has a lower portion with a stepped configuration as viewed from a side.

14. The wellbore mill of claim 11 further comprising orienting apparatus connected to the whipstock for orienting the whipstock.

15. The wellbore mill of claim 11 wherein the whipstock is a through-tubing whipstock.

16. The wellbore mill of claim 12 wherein the anchor apparatus is a through-tubing anchor apparatus.

17. The wellbore mill of claim 1 wherein the body has a scalloped cross-section defined by a series of alternating projections and valleys.

18. The wellbore milling method of claim 17 wherein at least some of the plurality of milling inserts are disposed in at least some of the projections.

19. The wellbore mill of claim 1 wherein the mill is a window mill.

20. The wellbore mill of claim 19 in combination with a watermelon mill spaced-apart therefrom.

21. The wellbore mill of claim 1 wherein the mill is a watermelon mill.

22. The wellbore mill of claim 1 wherein each insert is also secured in a recess by welding or brazing.

23. A wellbore milling method for milling an opening in a selected tubular member of a tubular string in a wellbore, the method comprising installing a mill on a working string into the wellbore at a selected desired point for milling an opening in the selected tubular member, the mill comprising a body having a top and a bottom, milling apparatus on the body, and the milling apparatus comprising a plurality of milling inserts, each insert mechanically secured in a corresponding recess in the body, said mechanical securement sufficient for effective milling in a wellbore, wherein each insert of the plurality of milling inserts has a generally cylindrical body with a top that is round as viewed from above, the top having a mid-portion and two spaced-apart side portions, the spaced apart side portions extending downwardly below the mid-portion of the top, and wherein the recess for each insert is sized and configured so that outer edges of the two side portions of the insert are disposed below an upper edge of the recess in which the insert is secured, and rotating the mill to mill an opening in the selected tubular member.

24. The wellbore milling method of claim 23 wherein the body has a fluid flow channel extending therethrough from top to bottom, the method further comprising creating a core of material of the selected tubular member by milling the selected tubular member, said core received into at least a lower end of the fluid flow channel, and separating with said mill said core from said selected tubular member.

25. The wellbore milling method of claim 23 wherein the body of the mill has a whipstock selectively releasably connected thereto and an anchor apparatus is connected to the whipstock, the method further comprising installing the mill on a working string into the wellbore further comprising activating the anchoring apparatus to anchor the mill and whipstock at a desired location in the tubular string, releasing the mill from the whipstock, and commencing milling of the selected tubular member.

26. The wellbore milling method of claim 23 wherein the body of the mill has a whipstock selectively releasably connected thereto and an orientation apparatus is connected to the whipstock, the method further comprising, prior to milling the selected tubular member, orienting the whipstock to a desired position within the wellbore.

27. The wellbore milling method of claim 25 wherein the anchor apparatus is a through-tubing anchor apparatus and the whipstock is a through-tubing whipstock, the tubular string in the wellbore comprising a first string portion with a first inner diameter and a second string portion connected to and below the first string portion, the second string portion having an inner diameter greater than that of the first string portion, and the selected tubular member part of the second string portion, the method further comprising prior to commencing milling, inserting the mill, whipstock, and anchor apparatus through the first string portion into the second string portion to a location adjacent the selected tubular member.

* * * * *